US005362409A

United States Patent [19]

Wiggins et al.

[11] Patent Number: 5,362,409

[45] Date of Patent: * Nov. 8, 1994

[54] GREASE COMPOSITIONS

[75] Inventors: Gary W. Wiggins, Willowick; Edward J. Konzman, Eastlake; James N. Vinci, Mayfield Heights; Patricia R. Todd, Chardon, all of Ohio

[73] Assignee: The Lubrizol Corporation, Wickliffe, Ohio

[ * ] Notice: The portion of the term of this patent subsequent to Oct. 26, 2010 has been disclaimed.

[21] Appl. No.: 142,583

[22] Filed: Oct. 25, 1993

Related U.S. Application Data

[63] Continuation-in-part of Ser. No. 911,833, Jul. 10, 1993, Pat. No. 5,256,321, and a continuation-in-part of Ser. No. 911,443, Jul. 10, 1993, Pat. No. 5,256,320.

[51] Int. Cl.[5] ..... C10M 137/04

[52] U.S. Cl. ..... 252/32.7 E; 252/33; 252/18; 252/41; 252/25; 252/49.8

[58] Field of Search ..... 252/32.7 E, 18, 25, 252/41, 49.8, 33

[56] References Cited

U.S. PATENT DOCUMENTS

| | | | |
|---|---|---|---|
| 2,802,856 | 8/1957 | Norman et al. | 260/461 |
| 2,872,417 | 2/1959 | Jordan et al. | 252/42.1 |
| 2,923,682 | 2/1960 | Morway | 252/32.7 |
| 3,033,787 | 5/1962 | Morway et al. | 252/39 |
| 3,174,931 | 3/1965 | Matson et al. | 252/37.2 |
| 3,197,405 | 7/1965 | LeSuer | 252/32.7 |
| 3,318,807 | 5/1967 | Lyons et al. | 252/41 |
| 3,341,633 | 9/1967 | Asseff | 260/978 |
| 3,389,085 | 6/1968 | Norway | 252/41 |
| 4,410,435 | 10/1983 | Naka et al. | 252/42.1 |
| 4,536,308 | 8/1985 | Pehler et al. | 252/32.7 |
| 4,582,617 | 4/1986 | Doner et al. | 252/32.7 |
| 4,600,517 | 7/1986 | Doner et al. | 252/32.7 |
| 4,655,948 | 4/1987 | Doner et al. | 252/49.6 |
| 4,743,386 | 5/1988 | Doner et al. | 252/49.6 |
| 4,752,416 | 6/1988 | Scharf et al. | 252/49.8 |
| 4,780,227 | 10/1988 | Doner et al. | 252/32.7 |
| 4,781,850 | 11/1988 | Doner et al. | 252/49.6 |
| 4,828,732 | 5/1989 | Doner et al. | 252/32.7 |
| 4,828,734 | 5/1989 | Doner et al. | 252/49 |
| 4,842,752 | 6/1989 | Hardy et al. | 252/17 |
| 4,897,210 | 6/1990 | Newsorff | 252/41 |
| 4,961,868 | 10/1990 | Doner et al. | 252/32.7 |
| 5,068,045 | 11/1991 | Doner et al. | 252/32.7 |
| 5,084,194 | 1/1992 | Doner et al. | 252/32.7 |
| 5,256,320 | 10/1993 | Todd et al. | 252/32.7 E |
| 5,256,321 | 10/1993 | Todd | 252/32.7 E |

FOREIGN PATENT DOCUMENTS

| | | | |
|---|---|---|---|
| 952088 | 7/1974 | Canada . | |
| 0084910 | 8/1983 | European Pat. Off. | C10M 5/14 |
| 0227182 | 12/1986 | European Pat. Off. | C10M 129 |
| 2090189 | 5/1971 | France | C10M 5/00 |

OTHER PUBLICATIONS

Lubrizol Anglamol ® 99 Brochure, The Lubrizol Corporation Jun. 1992.

Lubizol ® 885 Grease Brochure, The Lubrizol Corporation Nov. 1990.

Lubrizol ® 5002 Industrial Gear Brochure, The Lubrizol Corporation Nov. 1990.

Lubrizol ® 5080 Component Brochure, The Lubrizol Corporation date unknown.

Lubrizol ® 5080A Component Brochure, The Lubrizol Corporation Jan. 1991.

Lubrizol ® 5034 Industrial Gear Brochure, The Lubrizol Corporation Nov. 1990.

Lubrizol ® 5034A Industrial Gear Brochure, The Lubrizol Corporation Nov. 1990.

Lubrizol 5201 Grease Brochure, The Lubrizol Corporation Nov. 1990.

NLGI Lubricating Grease Guide-pp. 1.05–1.20, 2.09–2.18, 3.01–3.28, 4.08–4.12, and i–xv copyright date 1987.

*Primary Examiner*—Jacqueline V. Howard

*Attorney, Agent, or Firm*—Joseph P. Fischer; Frederick D. Hunter, Sr.; James L. Cordek

[57] ABSTRACT

Improved grease compositions comprise a major amount of an oil based metal soap thickened base grease selected from the group consisting of complex and failed complex greases, at least one sulfur and phosphorus containing composition alone or together with an overbased metal salt of an organic acid and a hydrocarbyl phosphite, in amounts sufficient to increase the dropping point of the base grease, as measured by ASTM Procedure D-2265 by at least 15° C., the phosphorus and sulfur compound being described in detail herein.

53 Claims, No Drawings

GREASE COMPOSITIONS

CROSS-REFERENCE TO RELATED APPLICATIONS

This is a continuation-in-part of applications Ser. No. 07/911,833 filed Jul. 10, 1993 now U.S. Pat. No. 5,256,329 and Ser. No. 07/911,443 filed Jul. 10, 1993 now U.S. Pat. No. 5,256,320. The disclosures of these applications are hereby incorporated herein by reference in their entirety.

FIELD OF THE INVENTION

This invention relates to grease compositions. More particularly, it relates to metal soap thickened base greases having dropping points as measured by ASTM Procedure D-2265 increased by adding certain components described in detail hereinbelow.

BACKGROUND OF THE INVENTION

Man's need to reduce friction dates back to ancient times. As far back as 1400 B.C., both mutton fat and beef fat (tallow) were used in attempting to reduce axle friction in chariots.

Until the mid-1800's, lubricants continued to be primarily mutton and beef fats, with certain types of vegetable oils playing minor roles. In 1859, however, Colonel Drake drilled his first oil well. Since that time most lubricants, including greases, have been based on petroleum ("mineral") oil, although synthetic oil based lubricants are used for special applications.

In the *NLGI Lubricating Grease Guide*, C 1987, available from the National Lubricating Grease Institute, Kansas City, Mo., USA, is a detailed discussion of greases, including various types of thickeners. Such thickeners include simple metal soap, complex metal salt-metal soap and non-soap thickened greases.

Simple metal soap thickened greases have provided exemplary performance. However, under certain conditions an increased dropping point as measured by ASTM Procedure D-2265 is required.

One way to increase the dropping point of base greases is to convert a simple metal soap grease to a complex grease by incorporating therein certain acids, typically carboxylic acids such as acetic acid, alpha-omega-dicarboxylic acids and certain aromatic acids. This process necessarily consumes considerable time resulting in reduced production. Nevertheless, complex greases provide highly desirable properties and are widely used. Oftentimes complexing does not take place and the grease retains substantially the properties of the corresponding simple soap grease. Such greases are referred to herein as failed complex greases. Reasons for failure to achieve complex formation are not well understood.

Doner et al, in a series of U.S. Patents, specifically, U.S. Pat. Nos.

| | | |
|---|---|---|
| 5,084,194 | 5,068,045 | 4,961,868 |
| 4,828,734 | 4,828,732 | 4,781,850 |
| 4,780,227 | 4,743,386 | 4,655,948 |
| 4,600,517 | 4,582,617 | |

teaches increased thickening of metal salt thickened base greases is obtained employing a wide variety of boron-containing compounds. Other additives contemplated for use with boron-containing compounds are phosphorus- and sulfur-containing materials, particularly zinc dithiophosphates.

Reaction products of O,O-dihydrocarbyl-phosphorodithioic acids with epoxides are described by Asseff in U.S. Pat. No. 3,341,633. These products are described as gear lubricant additives and as intermediates for preparing lubricant additives.

U.S. Pat. No. 3,197,405 (LeSuer) describes phosphorus and nitrogen containing compositions prepared by forming an acidic intermediate by the reaction of a hydroxy substituted triester of a phosphorothioic acid with an inorganic phosphorus reagent and neutralizing a substantial portion of said acidic intermediate with an amine. These compositions are described as lubricant additives.

U.S. Pat. No. 4,410,435 (Naka et al) teaches a lithium complex grease containing a base oil, a fatty acid having 12–24 carbon atoms, a dicarboxylic acid having 4–12 carbon atoms and/or a dicarboxylic acid ester and lithium hydroxide thickened with a phosphate ester and/or a phosphite ester.

The aforementioned copending applications relate to improved grease compositions comprising a major amount of an oil-based simple metal soap thickened base grease and minor amounts of additives to increase the dropping point of the base grease. The additives comprise a phosphorus and sulfur containing composition, alone, or together with an overbased metal salt of an organic acid and a hydrocarbyl phosphite, said phosphorus and sulfur containing composition selected from the group described in greater detail hereinbelow.

SUMMARY OF THE INVENTION

This invention relates to improved metal soap thickened base greases selected from the group consisting of complex greases and failed complex greases. The improvement comprises greases having increased dropping points arising from incorporation therein of certain additives compared to the greases without the additional additives.

In one embodiment this invention relates to improved grease compositions substantially free of boron and boron-containing compounds, comprising a major amount of an oil-based metal soap complex or failed complex base grease and a minor amount of at least one phosphorus and sulfur containing composition sufficient to increase the dropping point of the base grease, as determined by ASTM procedure D-2265, by at least 15° C., said phosphorus and sulfur containing composition selected from the group described in greater detail hereinbelow.

In another embodiment this invention relates to improved grease compositions comprising a major amount of an oil-based metal soap complex or failed complex base grease and minor amounts of (A) an overbased metal salt of an organic acid, (B) at least one phosphorus and sulfur containing composition and (C) a hydrocarbyl phosphite, together, in amounts sufficient to increase the dropping point of the base grease, as determined by ASTM procedure D-2265, said phosphorus and sulfur containing composition selected from the group described in greater detail hereinbelow.

The greases of this invention are useful for lubricating, sealing and protecting mechanical components such as gears, axles, beatings, shafts, hinges and the like. Such mechanical components are found in automobiles, trucks, bicycles, steel mills, mining equipment, railway equipment including rolling stock, aircraft, boats, construction equipment and numerous other types of industrial and consumer machinery.

DETAILED DESCRIPTION OF THE INVENTION

Heat resistance of greases is measured in a number of ways. One measure of heat resistance is the dropping point. Grease typically does not have a sharp melting point but rather softens until it no longer functions as a thickened lubricant. The American Society for Testing and Materials (1916 Race Street, Philadelphia, Pa.) has set forth a test procedure, ASTM D-2265, which provides a means for measuring the dropping point of greases.

In general, the dropping point of a grease is the temperature at which the grease passes from a semisolid to a liquid state under the conditions of the test. The dropping point is the temperature at which the first drop of material falls from the test cup employed in the apparatus used in ASTM procedure D-2265.

For many applications simple metal soap thickened base greases are entirely satisfactory. However, for some applications, greater heat resistance manifested by a dropping point above that possessed by simple metal soap thickened greases is desirable.

Complex metal soap greases provide increased dropping point, but have a number of significant drawbacks. Complex thickeners involve in addition to a fatty acid component, a non-fatty acid, e.g., benzoic, lower aliphatic, organic dibasic acids, etc. component. By lower aliphatic is meant $C_1$–$C_7$ aliphatic. The formation of the complex grease typically requires extended heating periods, sometimes several times that required to prepare a simple metal soap thickened grease.

Nevertheless, because of their generally good high-temperature properties complex greases are in demand. As mentioned hereinabove, from time to time attempts to form complex greases fail, resulting in a grease having substantially the same dropping point as the corresponding simple metal soap thickened grease.

While the failed greases are thickened, they do not possess the same high temperature properties as the successful complex greases. Failure usually is manifested by a dropping point significantly (e.g., often 20°–50° C. or more) lower than that displayed by the successful complex grease.

It is desirable to bring failed complex greases up to successful complex grease standards. It is also desirable to provide a means to further increase dropping points of complex grease compositions.

Thus, it is an object of this invention to provide novel grease compositions.

It is a further object of this invention to provide grease compositions having valuable properties.

It is another object of this invention to provide grease compositions having improved thermal (heat) stability as indicated by an increased dropping point as measured by ASTM Procedure D-2265.

Another object is to provide a means for bringing failed complex base greases up to complex grease standards.

A further object is to provide a means for increasing the dropping point of complex greases to levels exceeding that of the base complex grease.

Other objects will become apparent to the skilled person upon reading the specification and description of this invention.

The grease compositions of this invention display dropping points greater than the dropping point of the corresponding complex or failed complex metal soap thickened base grease. This benefit is obtained by incorporating into a complex or failed complex base grease certain sulfur and phosphorus containing compositions alone, or together with an overbased organic acid and a hydrocarbyl phosphite in amounts sufficient to increase the dropping point of the corresponding base grease as measured by ASTM Procedure D-2265.

Greases are frequently exposed to water. Thus, it is desirable that general purpose greases be substantially free of components that are readily adversely affected by water.

Many boron-containing compounds are sensitive to water, either being water-soluble, being subject to leaching from the grease into water or being readily hydrolyzed yielding undesirable hydrolysis products or to hydrolysis products which readily leach out into water. Preferably, the grease of this invention is substantially free of boron and boron-containing compounds.

The expression "substantially free of" means that the material referred to is absent, or if present, only in amounts having an essentially unmeasurable or insignificant effect on the grease composition.

Greases of this invention are prepared by thickening an oil basestock. The greases of this invention are oil-based, that is, they comprise an oil which has been thickened with a metal soap.

Complex greases are formed by reaction of a metal-containing reagent with two or more acids. One of the acids is a fatty acid or reactive derivative thereof and the other is an aromatic acid such as benzoic acid, an alpha-omega dicarboxylic acid such as azelaic acid, a lower carboxylic acid such as acetic acid and the like. The metal soap is the salt of the fatty acid and the non-fatty acid is the complexing agent.

A common procedure for preparing complex grease is carded out in two steps, the normal (simple) soap is formed first then it is complexed by reaction with the second acid. Alternatively the complex grease may be formed by reacting a mixture of the acids with the metal reagent. As stated above, the acid reactants may be reactive derivatives of the acid, such as esters. The reaction is typically conducted in a portion of the oil base and the remainder of the oil is added after complexation is completed. This permits more rapid cooling of the grease allowing subsequent processing, such as milling, to be conducted soon after the grease is formed.

There is no absolute industry standard defining the dropping point of a complex grease. However, it is often accepted that minimum dropping points of about 260° C. are displayed by complex greases. However, a more general definition of a complex grease is one which is prepared as described hereinabove and which displays a dropping point significantly higher, typically at least about 20° C. higher, than the corresponding simple metal soap grease.

As noted herein, the dropping point of a failed complex grease is usually about the same as that of the corresponding simple metal soap grease.

It can be concluded, then, that a metal soap contributes to the thickening of both the successful and failed complex grease. Thus, both the successful complex grease and the failed complex grease are referred to herein as metal soap thickened greases, but are distinguished from simple metal soap greases as defined herein.

The grease compositions of this invention employ an oil of lubricating viscosity, including natural or synthetic lubricating oils and mixtures thereof. Natural oils include animal oils, vegetable oils, mineral oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicone-based oils and mixtures thereof.

Specific examples of oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by *D. V. Brock*, "Lubricant Base Oils", *Lubricant Engineering*, volume 43, pages 184–185, March 1987. This article is incorporated herein by reference for its disclosures relating to lubricating oils. A description of oils of lubricating viscosity occurs in U.S. Pat. No. 4,582,618 (Davis) (column 2, line 37 through column 3, line 63, inclusive), incorporated herein by reference for its disclosure to oils of lubricating viscosity.

Another source of information regarding oils used to prepare lubricating greases is *NLGI Lubricating Grease Guide*, National Lubricating Grease Institute, Kansas City, Mo. (1987), pp 1.06–1.09, which is expressly incorporated herein by reference.

The metal soap portion of the greases of this invention are well-known in the art. These metal soaps are present in a base oil, typically an oil of lubricating viscosity in amounts, typically from about 1 to about 30% by weight, more often from about 1 to about 15% by weight, of the base grease composition. In many cases, the amount of metal soap used to thicken the base oil constitutes from about 5% to about 25% by weight of base grease. In other cases from about 2% to about 15% by weight of metal soap is present in the base grease.

The specific amount of metal soap required often depends on the metal soap employed. The type and amount of metal soap employed is frequently dictated by the desired nature of the grease.

The type and mount of metal soap to use is also dictated by the desired consistency, which is a measure of the degree to which the grease resists deformation under application of force. Consistency is usually indicated by the ASTM Cone penetration test, ASTM D-217 or ASTM D-1403.

Types and amounts of metal soap thickeners to employ are well-known to those skilled in the grease art. The aforementioned *NLGI Lubricating Grease Guide*, pp 1.09–1.11 and 1.14–1.15 provides a description of metal soap thickeners and soap complexes. This text is hereby incorporated herein by reference for its disclosure of metal soap grease thickeners.

As indicated hereinabove the grease compositions of this invention are oil based, including both natural and synthetic oils. Greases are made from these oils by incorporating a thickening agent therein. Thickening agents useful in the greases of this invention are the metal soaps. By metal soap is meant the substantially stoichiometrically neutral metal salts of fatty acids and additional aliphatic and/or aromatic acids which are not fatty acids as defined herein. By substantially stoichiometrically neutral is meant that the metal salt contains from about 90% to about 130% of the metal required to prepare the stoichiometrically neutral salt, preferably from about 95% to about 120%, more preferably 99% to 110%.

Fatty acids are defined herein as carboxylic acids containing from about 8 to about 24, preferably from about 12 to about 18 carbon atoms. The fatty acids are usually monocarboxylic acids. Examples of useful fatty acids are capric, palmitic, stearic, oleic and others. Mixtures of acids are useful. Preferred carboxylic acids are linear; that is they are substantially free of hydrocarbon branching.

Particularly useful acids are the hydroxy-substituted fatty acids such as hydroxy stearic acid wherein one or more hydroxy groups may be located at internal positions on the carbon chain, such as 12-hydroxy-, 14-hydroxy-, etc. stearic acids.

While the soaps are fatty acid salts, they need not be, and frequently are not, prepared directly from fatty acids. The typical grease-making process involves saponification of a fat which is often a glyceride or of other esters such as methyl or ethyl esters of fatty acids, preferably methyl esters, which saponification is generally conducted in situ in the base oil making up the grease.

Whether the metal complex grease is prepared from acids or esters, greases are usually prepared in a grease kettle or other reactor such as described by K. G. Timm in "Grease Mixer Design", *NLGI Spokesman*, June, 1980. Such other reactors include contactors and continuous grease-forming reactors. The mixture of base oil, fat, ester, fatty acid or non-fatty acid and metal-containing reactant react to form the soap in-situ. As mentioned hereinabove, the complexing acids or reactive derivatives thereof may be present during soap formation or may be incorporated afterwards. Additives for use in the grease may be added during grease manufacture, but are often added following formation of the base grease.

The metals of the metal soap greases of this invention are typically alkali metals, alkaline earth metals and aluminum. For purposes of cost and ease of processing, the metals are incorporated by reacting the acid reactants with basic metal containing reactants such as oxides, hydroxides, carbonates and alkoxides (typically lower alkoxides, those containing from 1 to 7 carbon atoms in the alkoxy group). The soap and complex salts may also be prepared from the metal itself although many metals are either too reactive or insufficiently reactive with the fat, ester or fatty acid to permit convenient processing.

As stated hereinabove complex greases are prepared from a mixture of acids, one of which is a fatty acid and one which is not a fatty acid as defined herein. The non-fatty acid may be incorporated at any stage of the thickener formation.

Preferred metals are lithium, sodium, calcium, magnesium, barium and aluminum. Especially preferred are lithium, sodium and calcium; lithium is particularly preferred.

Preferred fatty acids are stearic acid, palmitic acid, oleic and their corresponding esters, including glycerides (fats). Hydroxy-substituted fatty acids and the corresponding esters, including fats are particularly preferred.

Preferred non-fatty acids employed in formation of complex greases include aromatic, lower aliphatic and dibasic acids. Representative examples are benzoic acid, acetic acid and azelaic acid.

These and other thickening agents are described in U.S. Pat. Nos. 2, 197,263; 2,564,561 and 2,999,066, and the aforementioned *NLGI Lubricating Grease Guide*, all of which are incorporated herein by reference for relevant disclosures of grease thickeners.

Complex greases, e.g., those containing metal soap-salt complexes such as metal soap-acetates, metal soap-dicarboxylates, etc. are not simple metal soap thickened greases.

For reasons which are not well-understood, complexation is sometimes not successful. Thus, although the processing is expected to and usually does, attain enhanced thermal properties of a complex grease, sometimes only a slight or no increase in dropping point is obtained. Such greases are described herein by the expression "failed complex" grease.

For the purposes of this invention, both successful complex greases and failed complex greases are grouped within the class of "metal soap thickened greases". Failed complex greases are referred to as such, and successful complex greases are referred to as complex greases.

The thickeners of both the successful complex and the failed complex greases are referred to herein as metal soap thickeners. It is to be understood that the metal soap thickener of the failed grease is not a simple metal soap but, as evidenced by its inability to cause complex grease formation it obviously does not possess the same characteristics as does the metal salt complex of the successful complex grease. The distinction lies in the high temperature properties of the resulting grease composition.

(A) The Overbased Metal Salt of an Organic Acid

Component (A) is an overbased metal salt of an organic acid. The overbased materials are characterized by metal content in excess of that which would be present according to the stoichiometry of the metal and organic acid reactant. The mount of excess metal is commonly reported in terms of metal ratio. The term "metal ratio" is the ratio of the equivalents of metal base to the equivalents of the organic acid substrate. A neutral salt has a metal ratio of one. Overbased materials have metal ratios greater than 1, typically from 1.1 to about 40 or more.

Preferred metals are Group I and Group II metals (Chemical Abstracts (CAS) version of the Periodic Table of the Elements). Most preferred are sodium magnesium and calcium, with calcium being especially preferred.

In the present invention, the preferred overbased materials have metal ratios from about 1.1 to about 25, with metal ratios of from about 1.5 to about 20 being more preferred, and with metal ratios of from 5 to 15 being more preferred.

Generally, overbased materials useful in the present invention are prepared by treating a reaction mixture comprising an organic acid, a reaction medium comprising at least one solvent, a stoichiometric excess of a basic metal compound and a promoter with an acidic material, typically carbon dioxide. In some cases, particularly when the metal is magnesium, the acidic material may be replaced with water.

Organic Acids

The organic acids useful in making the overbased salts of the present invention include carboxylic acid, sulfonic acid, phosphorus-containing acid, phenol or mixtures of two or more thereof.

Carboxylic Acids

The carboxylic acids useful in making the salts (A) may be aliphatic or aromatic, mono- or polycarboxylic acid or acid-producing compounds. These carboxylic acids include lower molecular weight carboxylic acids (e.g., carboxylic acids having up to about 22 carbon atoms such as acids having about 4 to about 22 carbon atoms or tetrapropenyl-substituted succinic anhydride) as well as higher molecular weight carboxylic acids. Throughout this specification and in the appended claims, any reference to carboxylic acids is intended to include the acid-producing derivatives thereof such as anhydrides, lower alkyl esters, acyl halides, lactones and mixtures thereof unless otherwise specifically stated.

The carboxylic acids of the overbased metal salts employed in this invention are preferably oil-soluble and the number of carbon atoms present in the acid is important in contributing to the desired solubility. Usually, in order to provide the desired oil-solubility, the number of carbon atoms in the carboxylic acid should be at least about 8, more preferably about 12, more preferably at least about 18, even more preferably up to about 30. Generally, these carboxylic acids do not contain more than about 400 carbon atoms per molecule, preferably no more than about 100, more preferably no more than about 50.

The lower molecular weight monocarboxylic acids contemplated for making the overbased metal salts for use in this invention include saturated and unsaturated acids. Examples of such useful acids include dodecanoic acid, decanoic acid, oleic acid, stearic acid, linoleic acid, tall oil acid, etc. Mixtures of two or more such agents can also be used. An extensive discussion of these acids is found in Kirk-Othmer "Encyclopedia of Chemical Technology" Third Edition, 1978, John Wiley & Sons New York, pp. 814–871; these pages being incorporated herein by reference.

Examples of lower molecular weight polycarboxylic acids include dicarboxylic acids and derivatives such as sebacic acid, cetyl malonic acid, tetrapropylene-substituted succinic anhydride, etc. Lower alkyl esters of these acids can also be used.

The monocarboxylic acids include isoaliphatic acids. Such acids often contain a principal chain having from about 14 to about 20 saturated, aliphatic carbon atoms and at least one but usually no more than about four pendant acyclic lower alkyl groups. Specific examples of such isoaliphatic acids include 10-methyl-tetradecanoic acid, 3-ethyl-hexadecanoic acid, and 8-methyl-octadecanoic acid.

The isoaliphatic acids include mixtures of branch-chain acids prepared by the isomerization of commercial fatty acids (e.g. oleic, linoleic or tall oil acids) of, for example, about 16 to about 20 carbon atoms.

The higher molecular weight mono- and polycarboxylic acids suitable for use in making the salts (A) are well known in the art and have been described in detail, for example, in the following U.S., British and Canadian patents: U.S. Pat. Nos. 3,024,237; 3,172,892; 3,219,666; 3,245,910; 3,271,310; 3,272,746; 3,278,550; 3,306,907;

3,312,619; 3,341,542; 3,367,943; 3,374,174; 3,381,022; 3,454,607; 3,470,098; 3,630,902; 3,755,169; 3,912,764; and 4,368,133; British Patents 944,136; 1,085,903; 1,162,436; and 1,440,219; and Canadian Patent 956,397. These patents are incorporated herein by references for their disclosure of higher molecular weight mono- and polycarboxylic acids and methods for making the same.

A group of useful aromatic carboxylic acids are those of the formula

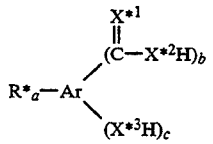

(XV)

wherein in Formula XV, R* is an aliphatic hydrocarbyl group of preferably about 4 to about 400 carbon atoms, a is a number in the range of zero to about 4, Ar is an aromatic group, $X^{*1}$, $X^{*2}$ and $X^{*3}$ are independently sulfur and oxygen, b is a number in the range of from 1 to about 4, c is a number in the range of 1 to about 4, usually 1 to 2, with the proviso that the sum of a, b and c does not exceed the number of valences of Ar. Preferably, R* and a are such that there is an average of at least about 8 aliphatic carbon atoms provided by the R* groups in each compound represented by Formula XV.

The aromatic group Ar in Formula XV may have the same structure as any of the aromatic groups Ar discussed below under the heading "Phenols". Examples of the aromatic groups that are useful herein include the polyvalent aromatic groups derived from benzene, naphthalene, anthracene, etc., preferably benzene. Specific examples of Ar groups include phenylenes and naphthylene, e.g., methylphenylenes, ethoxyphenylenes, isopropylphenylenes, hydroxyphenylenes, dipropoxynaphthylenes, etc.

Examples of the R* groups in Formula XV include butyl, isobutyl, pentyl, octyl, nonyl, dodecyl, and substituents derived from polymerized olefins such as polyethylenes, polypropylenes,polyisobutylenes, ethylene-propylenecopolymers, oxidized ethylene-propylene copolymers, and the like.

Within this group of aromatic acids, a useful class of carboxylic acids are those of the formula

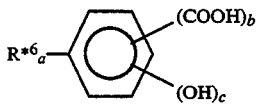

(XVI)

wherein Formula XVI, $R^{*6}$ is an aliphatic hydrocarbyl group preferably containing from about 4 to about 400 carbon atoms, a is a number in the range of from zero to about 4, preferably 1 to about 3; b is a number in the range of 1 to about 4, preferably 1 to about 2, c is a number in the range of 1 to about 4, preferably 1 to about 2, and more preferably 1; with the proviso that the sum of a, b and c does not exceed 6. Preferably, $R^{*6}$ and a are such that the acid molecules contain at least an average of about 12 aliphatic carbon atoms in the aliphatic hydrocarbon substituents per acid molecule.

Included within the class of aromatic carboxylic acids (XIV) are the aliphatic hydrocarbon-substituted salicylic acids wherein each aliphatic hydrocarbon substituent contains an average of at least about 8 carbon atoms per substituent and 1 to 3 substituents per molecule. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbons atoms are particularly useful.

The aromatic carboxylic acids corresponding to Formulae XV and XVI above are well known or can be prepared according to procedures known in the art. Carboxylic acids of the type illustrated by these formulae and processes for preparing their neutral and basic metals salts are well known and disclosed, for example, in U.S. Pat. Nos. 2,197,832; 2,197,835; 2,252,662; 2,252,664; 2,714,092; 3,410,798; and 3,595,791.

Sulfonic Acids

The sulfonic acids useful in making salts (A) used in the compositions of this invention include the sulfonic and thiosulfonic acids. Substantially neutral metal salts of sulfonic acids are also useful for preparing the overbased metal salts (A).

The sulfonic acids include the mono-or poly-nuclear aromatic or cycloaliphatic compounds. The oil-soluble sulfonic acids can be represented for the most part by the following formulae:

$$R^{\#1}{}_a\text{—T—}(SO_3H)_b \quad \text{(XVII)}$$

$$R^{\#2}\text{—}(SO_3H)_a \quad \text{(XVIII)}$$

In the above Formulae XVII and XVIII, T is a cyclic nucleus such as, for example, benzene, naphthalene, anthracene, diphenylene oxide, diphenylene sulfide, petroleum naphthenes, etc. $R^{\#1}$ preferably is an aliphatic group such as alkyl, alkenyl, alkoxy, alkoxyalkyl, etc.; a is at least 1, and $R^{\#1}{}_a$—T contains a total of at least about 15 carbon atoms. When $R^{\#2}$ is an aliphatic group it usually contains at least about 15 carbon atoms. When it is an aliphatic-substituted cycloaliphatic group, the aliphatic groups usually contain a total of at least about 12 carbon atoms. $R^{\#2}$ is preferably alkyl, alkenyl, alkoxyalkyl, carboalkoxyalkyl, etc. Specific examples of $R^{\#1}$ and $R^{\#2}$ are groups derived from petrolatum, saturated and unsaturated paraffin wax, and polyolefins, including polymerized, $C_2$, $C_3$, $C_4$, $C_5$, $C_6$, etc., olefins containing from about 15 to 700 or more carbon atoms. The groups T, $R^{\#1}$, and $R^{\#2}$ in the above Formulae XVII and XVIII can also contain other inorganic or organic substituents in addition to those enumerated above such as, for example, hydroxy, mercapto, halogen, nitro, amino, nitroso, sulfide, disulfide, etc. In Formula XVII, a and b are at least 1, and likewise in Formula XVIII, a is at least 1.

Specific examples of oil-soluble sulfonic acids are mahogany sulfonic acids; bright stock sulfonic acids; sulfonic acids derived from lubricating oil fractions; petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol monsulfide sulfonic acids, dilauryl beta naphthyl sulfonic acids, and alkaryl sulfonic acids such as dodecyl benzene "bottoms" sulfonic acids.

Alkyl-substituted benzene sulfonic acids wherein the alkyl group contains at least 8 carbon atoms including dodecyl benzene "bottoms" sulfonic acids are particularly useful. The latter are acids derived from benzene which has been alkylated with propylene tetramers or isobutene trimers to introduce 1, 2, 3 or more branched-chain $C_{12}$ substituents on the benzene ring. Dodecyl benzene bottoms, principally mixtures of mono- and di-dodecyl benzenes, are available as by product from the manufacture of household detergents. Similar products obtained from alkylation bottoms formed during manufacture of linear alkyl sulfonates (LAS) are also useful in making the sulfonates used in this invention.

The production of sulfonates from detergent manufactured byproducts by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Illustrative examples of these sulfonic acids include polybutene or polypropylene substituted naphthalene sulfonic acids, sulfonic acids derived by the treatment of polybutenes have a number average molecular weight ($\overline{M}n$) in the range of 700 to 5000, preferably 700 to 1200, more preferably about 1500 with chlorosulfonic acids, paraffin wax sulfonic acids, polyethylene ($\overline{M}n$ equals about 900–2000, preferably about 900–1500, more preferably 900–1200 or 1300) sulfonic acids, etc. Preferred sulfonic acids are mono-, di-, and tri-alkylated benzene (including hydrogenated forms thereof) sulfonic acids.

Also included are aliphatic sulfonic acids such as paraffin wax sulfonic acids, unsaturated paraffin wax sulfonic acids, hydroxy-substituted paraffin wax sulfonic acids, polyisobutene sulfonic acids wherein the polyisobutene contains from 20 to 7000 or more carbon atoms, chloro-substituted paraffin wax sulfonic acids, etc.; cycloaliphatic sulfonic acids such as petroleum naphthene sulfonic acids, lauryl cyclohexyl sulfonic acids, mono- or poly-wax-substituted cyclohexyl sulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A useful group of petroleum sulfonic acids are the mahogany sulfonic acids (so called because of their reddish-brown color) obtained as a by-product from the manufacture of petroleum white oils by a sulfuric acid process.

The basic (overbased) salts of the above-described synthetic and petroleum sulfonic acids are useful in the practice of this invention.

Phenols

The phenols useful in making the salts (A) used in the compositions of this invention can be represented by the formula $$R^{\#3}{}_a\text{—Ar—(OH)}_b \qquad \text{(XIX)}$$

wherein in Formula XIX, $R^{\#3}$ is a hydrocarbyl group of from about 4 to about 400 carbon atoms; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to about 4, more preferably 1 to about 2. $R^{\#3}$ and a are preferably such that there is an average of at least about 8 aliphatic carbon atoms provided by the $R^{\#3}$ groups for each phenol compound represented by Formula XIX.

While the term "phenol" is used herein, it is to be understood that this term is not intended to limit the aromatic group of the phenol to benzene. Accordingly, it is to be understood that the aromatic group as represented by "Ar" in Formula XIX, as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to about 6 sulfur atoms, etc.

The number of aromatic nuclei, fused, linked or both, in Ar can play a role in determining the integer values of a and b in Formula XIX. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The $R^{\#3}$ group in Formula XIX is a hydrocarbyl group that is directly bonded to the aromatic group Ar. $R^{\#3}$ preferably contains about 6 to about 80 carbon atoms, preferably about 6 to about 30 carbon atoms, more preferably about 8 to about 25 carbon atoms, and advantageously about 8 to about 15 carbon atoms. Examples of $R^{\#3}$ groups include butyl, isobutyl, pentyl, octyl, nonyl, dodecyl, 5-chlorohexyl, 4-ethoxypentyl, 3-cyclohexyloctyl, 2,3,5-trimethylheptyl, and substituents derived from polymerized olefins such as polyethylenes, polypropylenes, polyisobutylenes, ethylene-propylene copolymers, chlorinated olefin polymers, oxidized ethylene-propylene copolymers, propylene tetramer and tri(isobutene).

Metal Compounds

The metal compounds useful in making the overbased metal salts of the organic acids are generally basic metal compounds capable of forming salts with the organic acids, often oxides, hydroxides, carbonates, alkoxides, etc. Group I or Group II metal compounds (CAS version of Periodic Table of the Elements) are preferred. The Group I metals of the metal compound include alkali metals (sodium, potassium, lithium, etc.) as well as Group IB metals such as copper. The Group I metals are preferably sodium, potassium and copper, more preferably sodium or potassium, and more preferably sodium. The Group II metals of the metal base include the alkaline earth metals (magnesium, calcium, barium, etc.) as well as the Group IIB metals such as zinc or cadmium. Preferably the Group II metals are magnesium, calcium, or zinc, preferably magnesium or calcium, more preferably calcium.

Acidic Materials

An acidic material as defined hereinbelow, is often used to accomplish the formation of the overbased salt. The acidic material may be a liquid such as formic acid, acetic acid, nitric acid, sulfuric acid, etc. Acetic acid is particularly useful. Inorganic acidic materials may also be used such as HCl, $H_3BO_3$, $SO_2$, $SO_3$, $CO_2$, $H_2S$, etc., carbon dioxide being preferred. A preferred combination of acidic materials is carbon dioxide and acetic acid.

Promoter

A promoter is a chemical employed to facilitate the incorporation of metal into the basic metal compositions. Among the chemicals useful as promoters are water, ammonium hydroxide, organic acids of up to about 8 carbon atoms, nitric acid, sulfuric acid, hydrochloric acid, metal complexing agents such as alkyl salicylaldoxime, and alkali metal hydroxides such as lithium hydroxide, sodium hydroxide and potassium hydroxide, phenolic substances such as phenols and naphthols, mines such as aniline and dodecyl amine and mono- and polyhydric alcohols of up to about 30 carbon atoms. A comprehensive discussion of promoters is found in U.S. Pat. Nos. 2,777,874; 2,695,910; 2,616,904; 3,384,586 and 3,492,231. These patents are incorporated herein by reference for their disclosure of promoters. Especially useful are the monohydric alcohols having up to about 10 carbon atoms, mixtures of methanol with higher monhydric alcohols and phenolic materials.

Patents specifically describing techniques for making basic salts of the hereinabove-described sulfonic acids, carboxylic acids, and mixtures of any two or more of these include U.S. Pat. Nos. 2,501,731; 2,616,905; 2,616,911; 2,616,925; 2,777,874;3,256,186;3,384,585;3,365,396;3,320,162;3,318-,809;3,488,284;and 3,629,109. The disclosures of these patents are hereby incorporated in this present specification for their disclosures in this regard as well as for their disclosure of specific suitable basic metal salts.

As indicated hereinabove, the acidic material (e.g. $CO_2$, acetic acid, etc.) may be replaced with water. The resulting overbased salts are described as hydrated. These products are most often magnesium overbased compositions. U.S. Pat. No. 4,094,801 (Forsberg) and U.S. Pat. No. 4,627,928 (Karn) describe such compositions and methods for making same. These patents are expressly incorporated herein for relevant disclosures of hydrated overbased metal salts of organic acids.

A large number of overbased metal salts are available for use in the compositions of this invention. Such overbased salts are well known to those skilled in the art. The following Examples are provided to illustrates types of overbased materials. These illustrations are not intended to limit the scope of the claimed invention. Unless indicated otherwise, all parts are parts by weight and temperatures are in degrees Celsius.

EXAMPLE A-1

A mixture of 906 grams of an oil solution of an alkyl phenyl sulfonic acid (having an average molecular weight of 450, vapor phase osmometry), 564 grams mineral oil, 600 grams toluene, 98.7 grams magnesium oxide and 120 grams water is blown with carbon dioxide at a temperature of 78°–85° C. for 7 hours at a rate of about 3 cubic feet of carbon dioxide per hour. The reaction mixture is constantly agitated throughout the carbonation. After carbonation, the reaction mixture is stripped to 165° C./20 torr and the residue filtered. The filtrate is an oil solution (34% oil) of the desired overbased magnesium sulfonate having a metal ratio of about 3.

EXAMPLE A-2

A mixture of 160 grams of blend oil, 111 grams of polyisobutenyl (number average molecular weight=950) succinic anhydride, 52 grams of n-butyl alcohol, 11 grams of water, 1.98 grams of Peladow (a product of Dow Chemical identified as containing 94–97% $CaCl_{12}$) and 90 grams of hydrated lime are mixed together. Additional hydrated lime is added to neutralize the subsequently added sulfonic acid, the amount of said additional lime being dependent upon the acid number of the sulfonic acid. An oil solution (1078 grams, 58% by weight of oil) of a straight chain dialkyl benzene sulfonic acid (molecular weight=430) is added with the temperature of the reaction mixture not exceeding 79° C. The temperature is adjusted to 60° C. The reaction product of heptyl phenol, lime and formaldehyde (64.5 grams), and 217 grams of methyl alcohol are added. The reaction mixture is blown with carbon dioxide to a base number (phenolphthalein) of 20–30. Hydrated lime (112 grams) is added to the reaction mixture, and the mixture is blown with carbon dioxide to a base number (phenolphthalein) of 45–60, while maintaining the temperature of the reaction mixture at 46°–52° C. The latter step of hydrated lime addition followed by carbon dioxide blowing is repeated three more times with the exception with the last repetition the reaction mixture is carbonated to a base number (phenolphthalein) of 45–55. The reaction mixture is flash dried at 93°–104° C., kettle dried at 149°–160° C., filtered and adjusted with oil to a 12.0% Ca level. The product is an overbased calcium sulfonate having, by analysis, a base number (bromophenol blue) of 300, a metal content of 12.0% by weight, a metal ratio of 12, a sulfate ash content of 40.7% by weight, and a sulfur content of 1.5% by weight. The oil content is 53% by weight.

EXAMPLE A-3

A reaction mixture comprising 135 grams mineral oil, 330 grams xylene, 200 grams (0.235 equivalent) of a mineral oil solution of an alkylphenyl-sulfonic acid (average molecular weight 425), 19 grams (0.068 equivalent) of tall oil acids, 60 grams (about 2.75 equivalents) of magnesium oxide, 83 grams methanol, and 62 grams water is carbonated at a rate of 15 grams of carbon dioxide per hour for about two hours at the methanol reflux temperature. The carbon dioxide inlet rate is then reduced to about 7 grams per hour, and the methanol is removed by raising the temperature to about 98° C. over a three hour period. Water (47 grams) is added and carbonation is continued for an additional 3.5 hours at a temperature of about 95° C. The carbonated mixture is then stripped by heating to a temperature of 140°–145° C. over a 2.5 hour period. This results in an oil solution of a basic magnesium salt characterized by a metal ratio of about 10.

The carbonated mixture is cooled to about 60°–65° C., and 208 grams xylene, 60 grams magnesium oxide, 83 grams methanol and 62 grams water are added thereto. Carbonation is resumed at a rate of 15 grams per hour for two hours at the methanol reflux temperature. The carbon dioxide additional rate is reduced to 7 grams per hour and the methanol is removed by raising the temperature to about 95° C. over a three hour period. An additional 41.5 grams of water are added and carbonation is continued at 7 grams per hour at a temperature of about 90°–95° C. for 3.5 hours. The carbonated mass is then heated to about 150°–160° C. over a 3.5 hour period and then further stripped by reducing the pressure to 20 mm. (Hg.) at this temperature. The carbonated reaction product is filtered, and the filtrate is an oil-solution of the desired basic magnesium salt characterized by a metal ratio of about 20.

EXAMPLE A-4

A mixture of 835 grams of 100 neutral mineral oil, 118 grams of a polybutenyl (molecular weight=950)-substituted succinic anhydride, 140 grams of a 65:35 molar mixture of isobutyl alcohol and amyl alcohol, 43.2 grams of a 15% calcium chloride aqueous solution and 86.4 grams of lime is prepared. While maintaining the temperature below 80° C., 1000 grams of an 85% solution of a primary mono-alkyl benzene sulfonic acid, having a molecular weight of about 480, a neutralization acid number of 110, and 15% by weight of an organic diluent is added to the mixture. The mixture is dried at 150° C. to about 0.7% water. The mixture is cooled to 46°–52° C. where 127 grams of the isobutyl-amyl alcohol mixture described above, 277 grams of methanol and 87.6 grams of a 31% solution of calcium, formaldehyde-coupled, heptylphenol having a metal ratio of 0.8 and 2.2% calcium are added to the mixture. Three increments of 171 grams of lime are added separately and carbonated to a neutralization base number in the range of 50–60. A fourth lime increment of 171 grams is added and carbonated to a neutralization base number of (phenolphthalein) 45–55. Approximately 331 grams of carbon dioxide are used. The mixture is dried at 150° C. to approximately 0.5% water. The reaction mixture is filtered and the filtrate is the desired product. The product contains, by analysis, 12% calcium and has a metal ratio of 11. The product contains 41% oil.

EXAMPLE A-5

A reaction vessel is charged with 1122 grams (2 equivalents) of a polybutenyl-substituted succinic anhydride derived from a polybutene (Mn=1000, 1:1 ratio of polybutene to maleic acid), 105 grams (0.4 equivalent) of tetrapropenyl phenol, 1122 grams of xylene and 1000 grams of 100 neutral mineral oil. The mixture is stirred and heated to 80° C. under nitrogen, and 580 grams of a 50% aqueous solution of sodium hydroxide are added to the vessel over 10 minutes. The mixture is heated from 80° C. to 120° C. over 1.3 hours. The reaction mixture is carbonated at 1 standard cubic foot per hour (scfh) while removing water by azeotropic reflux. The temperature rises to 150° C. over 6 hours while 300 grams of water is collected. (1) The reaction mixture is cooled to about 80° C. whereupon 540 grams of 50% aqueous solution of sodium hydroxide are added to the vessel. (2) The reaction mixture is heated to 140° C. over 1.7 hours and water is removed at reflux conditions. (3) The reaction mixture is carbonated at 1 standard cubic foot per hour (scfh) while removing water for 5 hours. Steps (1)–(3) are repeated using 560 grams of an aqueous sodium hydroxide solution. Steps (1)–(3) are repeated using 640 grams of an aqueous sodium hydroxide solution. Steps ( 1 )–(3) are then repeated with another 640 grams of a 50% aqueous sodium hydroxide solution. The reaction mixture is cooled and 1000 grams of 100 neutral mineral oil are added to the reaction mixture. The reaction mixture is vacuum stripped to 115° C. at about 30 millimeters of mercury. The residue is filtered through diatomaceous earth. The filtrate has a total base number of 361, 43.4% sulfated ash, 16.0% sodium, 39.4% oil, a specific gravity of 1.11, and the overbased metal salt has a metal ratio of about 13.

EXAMPLE A-6

The overbased salt obtained in Example A-5 is diluted with mineral oil to provide a composition containing 13.75 sodium, a total base number of about 320, and 45% oil.

EXAMPLE A-7

A reaction vessel is charged with 700 grams of a 100 neutral mineral oil, 700 grams (1.25 equivalents) of the succinic anhydride of Example A-5 and 200 grams (2.5 equivalents) of a 50% aqueous solution of sodium hydroxide. The reaction mixture is stirred and heated to 80° C. whereupon 66 grams (0.25 equivalent) of tetrapropenyl phenol are added to the reaction vessel. The reaction mixture is heated from 80° C. to 140° C. over 2.5 hours while blowing of nitrogen and removing 40 grams of water. Carbon dioxide (28 grams, 1.25 equivalents) is added over 2.25 hours at a temperature from 140°–165° C. The reaction mixture is blown with nitrogen at 2 standard cubic foot per hour (scfh) and a total of 112 grams of water is removed. The reaction temperature is decreased to 115° C. and the reaction mixture is filtered through diatomaceous earth. The filtrate has 4.06% sodium, a total base number of 89, a specific gravity of 0.948, 44.5% oil, and the overbased salt has a metal ratio of about 2.

EXAMPLE A-8

A reaction vessel is charged with 281 grams (0.5 equivalent) of the succinic anhydride of Example A-5, 281 grams of xylene, 26 grams of tetrapropenyl substituted phenol and 250 grams of 100 neutral mineral oil. The mixture is heated to 80° C. and 272 grams (3.4 equivalents) of an aqueous sodium hydroxide solution are added to the reaction mixture. The mixture is blown with nitrogen at 1 scfh, and the reaction temperature is increased to 148° C. The reaction mixture is then blown with carbon dioxide at 1 scfh for one hour and 25 minutes while 150 grams of water are collected. The reaction mixture is cooled to 80° C. whereupon 272 grams (3.4 equivalents) of the above sodium hydroxide solution are added to the reaction mixture, and the mixture is blown with nitrogen at 1 scfh. The reaction temperature is increased to 140° C. whereupon the reaction mixture is blown with carbon dioxide at 1 scfh for 1 hour and 25 minutes while 150 grams of water are collected. The reaction temperature is decreased to 100° C., and 272 grams (3.4 equivalents) of the above sodium hydroxide solution are added while blowing the mixture with nitrogen at 1 scfh. The reaction temperature is increased to 148° C., and the reaction mixture is blown with carbon dioxide at 1 scfh for 1 hour and 40 minutes while 160 grams of water are collected. The reaction mixture is cooled to 90° C. and 250 grams of 100 neutral mineral oil are added to the reaction mixture. The reaction mixture is vacuum stripped at 70° C. and the residue is filtered through diatomaceous earth. The filtrate contains 50.0% sodium sulfate ash by ASTM D-874, total base number of 408, a specific gravity of 1.18, 37.1% oil, and the salt has a metal ratio of about 15.8.

EXAMPLE A-9

A solution of 780 parts ( 1 equivalent) of an alkylated benzenesulfonic acid (57% by weight 100 neutral mineral oil and unreacted alkylated benzene) and 119 parts (0.2 equivalents) of the polybutenyl succinic anhydride in 442 parts of mineral oil is mixed with 800 parts (20 equivalents) of sodium hydroxide and 704 parts (22 equivalents) of methanol. The mixture is blown with carbon dioxide at 7 cfh (cubic feet per hour) for 11 minutes as the temperature slowly increases to 97° C. The rate of carbon dioxide flow is reduced to 6 cfh and the temperature decreases slowly to 88° C. over about 40 minutes. The rate of carbon dioxide flow is reduced to 5 cfh. for about 35 minutes and the temperature slowly decreases to 73° C. The volatile materials are stripped by blowing nitrogen through the carbonated mixture at 2 cfh. for 105 minutes as the temperature is slowly increased to 160° C. After stripping is completed, the mixture is held at 160° C. for an additional 45 minutes and then filtered to yield an oil solution of the desired basic sodium sulfonate having a metal ratio of about 19.75.

EXAMPLE A-10

A blend is prepared of 135 parts of magnesium oxide and 600 parts of an alkylbenzenesulfonic acid having an equivalent weight of about 385, and containing about 24% unsulfonated alkylbenzene. During blending, an exothermic reaction takes place which causes the temperature to rise to 57° C. The mixture is stirred for one-half hour and then 50 parts of water is added. Upon heating at 95° C. for one hour, the desired magnesium oxide-sulfonate complex is obtained as a firm gel containing 9.07% magnesium.

EXAMPLE A-11

A reaction mixture comprising about 506 parts by weight of a mineral oil solution containing about 0.5 equivalent of a substantially neutral magnesium salt of an alkylated salicyclic acid wherein the alkyl groups have an average of about 16 to 24 aliphatic carbon atoms and about 30 parts by weight of an oil mixture containing about 0.037 equivalent of an alkylated benzenesulfonic acid together with about 22 parts by weight (about 1.0 equivalent) of a magnesium oxide and about 250 parts by weight of xylene is added to a flask and heated to temperatures of about 60° C. to 70° C. The reaction is subsequently heated to about 85° C. and approximately 60 parts by weight of water are added to the reaction mass which is then heated to the reflux temperature. The reaction mass is held at the reflux temperature of about 95°-100° C. for about 1½ hours and subsequently stripped at about 155° C., under 40 mm Hg, and filtered. The filtrate comprises the basic carboxylic magnesium salts and is characterized by a sulfated ash content of 15.59% (sulfated ash) corresponding to 274% of the stoichiometrically equivalent amount.

EXAMPLE A-12

A reaction mixture comprising approximately 1575 parts by weight of an oil solution containing about 1.5 equivalents of an alkylated 4-hydroxy-1,3-benzenedicarboxylic acid wherein the alkyl group has an average of at least about 16 aliphatic carbon atoms and an oil mixture containing about 0.5 equivalent of a tall oil fatty acid together with about 120 parts by weight (6.0 equivalents) of a magnesium oxide and about 700 parts by weight of an organic solvent containing xylene is added to a flask and heated to temperatures ranging from about 70°-75° C. The reaction is subsequently heated to about 85° C. and approximately 200 parts by weight of water are added to the reaction which is then heated to the reflux temperature. The reaction mass is held at the reflux temperature of about 95°-100° C. for about 3 hours and subsequently stripped at a temperature of about 155° C., under vacuum, and filtered. The filtrate comprises the basic carboxylic magnesium salts.

EXAMPLE A-13

A reaction mixture comprising approximately 500 parts by weight of an oil solution containing about 0.5 equivalent of an alkylated 1-hydroxy-2-naphthoic acid wherein the alkyl group has an average of at least about 16 aliphatic carbon atoms and an oil mixture containing 0.25 equivalent of a petroleum sulfonic acid together with about 30 parts by weight (1.5 equivalents) of a magnesium oxide and about 250 parts by weight of a hydrocarbon solvent is added to a reactor and heated to temperatures ranging to about 60°-75° C. The reaction mass is subsequently heated to about 85° C. and approximately 30 parts by weight of water are added to the mass which is then heated to the reflux temperature. The reaction mass is held at the reflux temperature of about 95°-100° C. for about 2 hours and subsequently stripped at a temperature of about 150° C., under vacuum, and filtered. The filtrate comprises the basic carboxylic magnesium metal salts.

EXAMPLE A-14

A calcium overbased salicylate is prepared by reacting in the presence of a mineral oil diluent a $C_{13-18}$ alkyl substituted salicylic acid with lime and carbonating in the presence of a suitable promotor such as methanol yielding a calcium overbased salicylate having a metal ratio of about 2.5. Oil content is about 38% by weight.

(B) The Phosphorus and Sulfur Containing Compositions

The phosphorus and sulfur containing compositions employed in the grease compositions of the instant invention include phosphorus and sulfur containing acids, salts and other derivatives and other compounds including thiophosphite compounds. Useful sulfur and phosphorus containing compounds are described in detail hereinbelow. These compounds, when used alone or together with an overbased organic acid and a hydrocarbyl phosphite in amounts indicated herein increase the dropping point of the complex and failed complex metal soap thickened base grease into which they are incorporated, as measured by ASTM Procedure D-2265.

This effect is surprising since these compounds, which are normally used as extreme pressure and antiwear compounds, detergents and antirust agents have not been observed to have a noticeable positive effect on dropping point at levels normally employed to improve said properties.

The effect on failed complex greases is surprising because a process which was expected to provide a grease having enhanced thermal properties failed to provide same. It is surprising to learn that the failed grease responds to the additives of this invention to provide a grease having enhanced thermal properties as indicated by the dropping point as measured according to ASTM D-2265.

Particularly surprising is the effect of the additives in a successful complex grease. Such a grease already possesses superior thermal properties. The significant enhancement thereof by the use of additives which normally are used in amounts to provide benefits such as extreme pressure, antirust and the like, when used in somewhat greater amounts, provide even greater enhancement of thermal properties of the complex grease as indicated by increased dropping point as measured by ASTM procedure D-2265.

Phosphorus- and sulfur-containing compositions useful in the greases of this invention for increasing the dropping point of complex and failed complex metal soap thickened base greases include (B-1) a compound represented by the formula

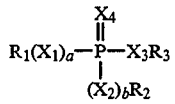

(I)

wherein each $X_1$, $X_2$, $X_3$ and $X_4$ is independently oxygen or sulfur provided at least one is sulfur; each a and b is independently 0 or 1; and wherein each $R_1$, $R_2$ and $R_3$ is independently hydrogen, hydrocarbyl, a group of the formula

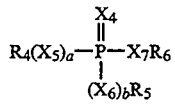

(II)

wherein each $R_4$ and $R_5$ is independently hydrogen or hydrocarbyl, provided at least one of $R_4$ and $R_5$ is hydrocarbyl, $R_6$ is an alkylene or alkylidene group, each a and b is independently 0 or 1, and each $X_5$, $X_6$, $X_7$ and $X_8$ is independently oxygen or sulfur; or a group of the formula $R_6OH$, wherein $R_6$ is an alkylene or alkylidene group;

(B-2) an amine or an ammonium salt of (A-1 ) when at least $R_3$ is hydrogen;

(B-3) a compound represented by the formula

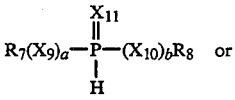

(III)

or

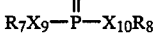

(IV)

wherein each $R_7$, $R_8$ and $R_9$ is independently hydrogen or a hydrocarbyl group provided at least one is hydrocarbyl, each $X_9$, $X_{10}$ and $X_{11}$ is independently oxygen or sulfur provided at least one is sulfur, and each a and b is independently 0 or 1; and (B-4) mixtures of two or more of (B-1) to (B-3) thereof.

In a preferred embodiment, a and b are each 1.

In one embodiment the sulfur- and phosphorus containing composition is the compound (B-1). Preferably, a and b are each 1. In one embodiment $R_1$ and $R_2$ are each independently hydrocarbyl groups containing from 1 to about 30 carbon atoms and $R_3$ is H or a hydrocarbyl group containing from 1 to about 30 carbon atoms.

In a particular embodiment, each of $R_1$, $R_2$ and $R_3$ is independently an alkyl group containing from 1 to about 18 carbon atoms or an aryl group containing from about 6 to about 18 carbon atoms, and more particularly each of $R_1$, $R_2$ and $R_3$ is independently a butyl, hexyl, heptyl, octyl, oleyl or cresyl group.

In another particular embodiment, $R_3$ is H. When $R_3$ is H it is preferred that each of $R_1$ and $R_2$ is independently an alkyl group containing from 1 to about 18 carbon atoms or an aryl group containing from about 6 to about 18 carbon atoms, and more particularly each of $R_1$ and $R_2$ is independently a butyl, hexyl, heptyl, octyl, oleyl or cresyl group.

In a preferred embodiment, each $R_1$, $R_2$ and $R_3$ is independently hydrogen or

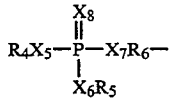

(V)

Preferably, $R_3$ is hydrogen and each $R_1$ and $R_2$ is independently hydrogen or

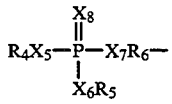

(V)

As mentioned hereinabove at least one of $X_1$, $X_2$, $X_3$ and $X_4$ must be sulfur while the remaining groups may be oxygen or sulfur. In one preferred embodiment one of $X_1$, $X_2$ and $X_3$ is sulfur and the rest are oxygen.

When $R_1$, $R_2$ or $R_3$ is a group of the formula

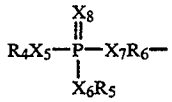

(V)

it is preferred that $X_5$ and $X_6$ are oxygen and $X_7$ and $X_8$ are sulfur, or one of $X_5$, $X_6$, $X_7$ and $X_8$ is sulfur and the rest are oxygen. In these cases preferably each of $X_3$ and $X_4$ is oxygen and more preferably $X_2$ is oxygen.

In a further embodiment each of $R_1$ and $R_2$ is independently hydrocarbyl having from 1 to about 30 carbon atoms and $R_3$ is $R_6OH$ wherein $R_6$ is an alkylene or alkylidene group containing from 2 to about 28 carbon atoms. In this case one of $X_1$, $X_2$, $X_3$ and $X_4$ is sulfur and the rest are oxygen. In a preferred embodiment, $X_3$ and $X_4$ are sulfur and $X_1$ and $X_2$ are oxygen. Also preferred is where $R_6$ is alkylene.

In another embodiment, the phosphorus and sulfur containing composition is the ammonium or amine salt (B-2). Preferably, a and b are each 1.

When any of $R_1$, $R_2$ or $R_3$ is H, the compound of Formula I is an acid. The salts (B-2) can be considered as being derived from that acid.

When (B-2) is the ammonium salt, the salt is considered as being derived from ammonia ($NH_3$) or ammonia yielding compounds such as $NH_4OH$. Other ammonia yielding compounds will readily occur to the skilled person.

When (B-2) is an amine salt, the salt may be considered as being derived from amines.

The amines may be primary, second,my or tertiary amines, or mixtures thereof. Hydrocarbyl groups of the amines may be aliphatic, cycloaliphatic or aromatic. Preferably the hydrocarbyl groups are aliphatic, more preferably alkyl or alkenyl, most preferably, alkyl.

When the amine is an alkylamine it is preferred that the alkyl group contains from 1 to about 24 carbon atoms.

In one preferred embodiment, the amines are primary hydrocarbyl amines containing from about 2 to about 30, more preferably about 4 to about 20, carbon atoms in the hydrocarbyl group. The hydrocarbyl group may be saturated or unsaturated. Representative examples of primary saturated amines are the alkyl amines such as methyl amines, n-butyl amine, n-hexyl amine; those known as aliphatic primary fatty amines, for example the commercially known "Armeen" primary amines (products available from Akzo Chemicals, Chicago, Ill.). Typical fatty amines include amines such as, n-octylamine, n-dodecylamine, n-tetradecylamine, n-octadecylamine (stearyl amine), octadecenyl amine (oleyl amine), etc. Also suitable are mixed fatty amines such as Akzo's Armeen-C, Armeen-O, Armeen-OD, Armeen-T, Armeen-HT, Armeen S and Armeen SD, all of which are fatty amines of varying purity.

In another preferred embodiment, the amine salts of this invention are those derived from tertiary-aliphatic primary amines having from about 4 to about 30, preferably about 6 to about 24, more preferably about 8 to about 24, carbon atoms in the aliphatic group.

Usually the tertiary aliphatic primary amines are monoamines, preferably alkyl amines represented by the formula

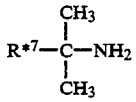

wherein $R^{*7}$ is a hydrocarbyl group containing from one to about 30 carbon atoms. Such amines are illustrated by tertiary-butyl amine, 1 -methyl- 1 -aminocyclohexane, tertiary-octyl primary amine, tertiary-tetradecyl primary amine, tertiary-hexadecyl primary amine, tertiary-octadecyl primary amine, tertiary-octacosanyl primary amine.

Mixtures of tertiary alkyl primary amines are also useful for the purposes of this invention. Illustrative of amine mixtures of this type are "Primene 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary alkyl primary amines and methods for their preparation are known to those of ordinary skill in the art. The tertiary alkyl primary amine useful for the purposes of this invention and methods for their preparation are described in U.S. Pat. No. 2,945,749 which is hereby incorporated by reference for its teaching in this regard.

Primary amines in which the hydrocarbyl group comprises olefinic unsaturation also are useful. Thus, the hydrocarbyl groups may contain one or more olefinic unsaturations depending on the length of the chain, usually no more than one double bond per 10 carbon atoms. Representative amines are dodecenylamine, oleylamine and linoleylamine. Such unsaturated amines are available under the Armeen tradename.

Secondary amines include dialkylamines having two of the above hydrocarbyl, preferably alkyl or alkenyl groups described for primary amines including such commercial fatty secondary amines as Armeen 2C and Armeen HT, and also mixed dialkylamines where, for example, one alkyl group is a fatty group and the other alkyl group may be a lower alkyl group (1–7 carbon atoms) such as ethyl, butyl, etc., or the other hydrocarbyl group may be an alkyl group bearing other nonreactive or polar substituents (CN, alkyl, carbalkoxy, amide, ether, thioether, halo, sulfoxide, sulfone) such that the essentially hydrocarbon character of the group is not destroyed.

Tertiary amines such as trialkyl or trialkenyl amines and those containing a mixture of alkyl and alkenyl amines are useful. The alkyl and alkenyl groups are substantially as described above for primary and secondary amines.

Other useful primary amines are the primary ether amines $R''OR'NH_2$ wherein R' is a divalent alkylene group having 2 to 6 carbon atoms and R'' is a hydrocarbyl group of about 5 to about 150 carbon atoms. These primary ether amines are generally prepared by the reaction of an alcohol R''OH wherein R'' is as defined hereinabove with an unsaturated nitrile. Typically, and for efficiency and economy, the alcohol is a linear or branched aliphatic alcohol with R'' having up to about 50 carbon atoms, preferably up to 26 carbon atoms and most preferably from 6 to 20 carbon atoms. The nitrile reactant can have from 2 to 6 carbon atoms, acrylonitrile being most preferred. Ether amines are commercially available under the name SURFAM marketed by Mars Chemical Company, Atlanta, Ga. Typical of such amines are those having from about 150 to about 400 molecular weight. Preferred etheramines are exemplified by those identified as SURFAM P14B (decyloxypropylamine), SURFAM P16A (linear $C_{16}$), SURFAM P17B (tridecyloxypropylamine). The C chain lengths (i.e., $C_{14}$, etc.) of the SURFAMS described above and used hereinafter are approximate and include the oxygen ether linkage. For example, a $C_{14}$ SURFAM amine would have the following general formula $$C_{10}H_{21}OC_3H_6NH_2$$

The amines used to form the amine salts may be hydroxyamines. In one embodiment, these hydroxyamines can be represented by the formula

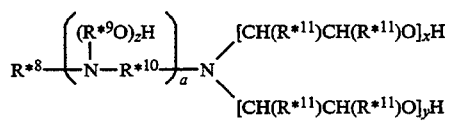

wherein $R^{*8}$ is a hydrocarbyl group generally containing from about 6 to about 30 carbon atoms, $R^{*9}$ is an ethylene or propylene group, $R^{*10}$ is an alkylene group containing up to about 5 carbon atoms, a is zero or one, each $R^{*11}$ is hydrogen or a lower alkyl group, and x, y and z are each independently integers from zero to about 10, at least one of x, y and z being at least 1.

The above hydroxyamines can be prepared by techniques well known in the art, and many such hydroxyamines are commercially available.

The useful hydroxyamines where a in the above formula is 0 include 2-hydroxyethylhexylamine, 2-hydroxyethyoleylamine, bis(2-hydroxyethyl)hexylamine, bis(2-hydroxyethyl)oleylamine, and mixtures thereof. Also included are the comparable members wherein in the above formula at least one of x and y is at least 2.

A number of hydroxyamines wherein a is zero are available from the Armak Chemical Division of Akzona, Inc., Chicago, Ill., under the general trade designation "Ethomeen" and "Propomeen". Specific examples include "Ethomeen C/15" which is an ethylene oxide condensate of a coconut fatty acid containing about 5 moles of ethylene oxide; "Ethomeen C/20" and "C/25" which also are ethylene oxide condensation products from coconut fatty acid containing about 10 and 15 moles of ethylene oxide respectively. "Propomeen O/12" is the condensation product of one mole of oleyl amine with 2 moles propylene oxide.

Commercially available examples of alkoxylated amines where a is 1 include "Ethoduomeen T/13" and "T/20" which are ethylene oxide condensation products of N-tallow trimethylene diamine containing 3 and 10 moles of ethylene oxide per mole of diamine, respectively.

The fatty diamines include mono- or dialkyl, symmetrical or asymmetrical ethylene diamines, propane diamines (1,2, or 1,3), and polyamine analogs of the above. Suitable fatty polyamines such as those sold under the name Duomeen are commercially available diamines described in Product Data Bulletin No. 7–10$R_1$ of Armak Chemical Co., Chicago, Ill. In another embodiment, the secondary amines may be cyclic amines such as piperidine, piperazine, morpholine, etc.

In a further embodiment the sulfur- and phosphorus-containing composition is (B-3). Preferably, a and b are each 1. In one embodiment, each $R_7$, $R_8$ and $R_9$ is independently hydrogen or a hydrocarbyl group having from about 1 to about 18 carbon atoms, and a and b are each 1. Preferably, each $R_7$, $R_8$ and $R_9$ is independently hydrogen or an alkyl or an aryl group selected from the group consisting of propyl, butyl, pentyl, hexyl, heptyl, oleyl, cresyl, or phenyl, provided at least one is said alkyl or aryl group.

In one preferred embodiment at least two of $X_9$, $X_{10}$ and $X_{11}$ are sulfur.

In another embodiment the sulfur- and phosphorus-containing composition may be (B-4) a mixture of two or more of the compounds represented by (B-1) to (B-3).

In another embodiment (B-1) is a thiophosphoric acid. The di-organo thiophosphoric acid materials used in this invention can be prepared by well known methods.

The O,O-di-organo dithiophosphoric acids can be prepared, for example, by reacting organic hydroxy compounds with phosphorus pentasulfide. Suitable organic hydroxy compounds include alcohols, such as, alkanols, alkanediols, cycloalkanols, alkyl-and cycloalkyl-substituted aliphatic alcohols, ether alcohols, ester alcohols and mixtures of alcohols; phenolic compounds, such as, phenol, cresol, xylenols, alkyl-substituted phenols, cycloalkyl-substituted phenols, phenyl-substituted phenols, alkoxy phenol, phenoxy phenol, naphthol, alkyl-substituted naphthols, etc. The non-benzenoid organic hydroxy compounds are generally the most useful in the preparation of the O,O-di-organo dithiophosphoric acids. A full discussion of the preparation of these compounds is in the Journal of the American Chemical Society, volume 67, (1945), page 1662.

The S,S-di-organo tetrathiophosphoric acids can be prepared by the same method described above, except that mercaptans are employed in place of the organic hydroxy compounds.

The O,S-di-organo trithiophosphoric acids can be prepared by the same manner employed in the preparation of the dithiophosphoric acids described above, except that a mixture of mercaptans and organic hydroxy compounds is reacted with phosphorus pentasulfide.

The phosphorus and sulfur containing compound (B-1) include, thiophosphoric acids including, but not limited to, dithiophosphoric as well as monothiophosphoric, thiophosphinic or thiophosphonic acids. The use of the term thiophosphoric, thiophosphonic or thiophosphinic acids is also meant to encompass monothio as well as dithio derivatives of these acids. Useful phosphorus-containing acids are described below.

In one embodiment, when a and b are 1, and one of $X_1$, $X_2$, $X_3$ or $X_4$ is sulfur and the rest are oxygen, the phosphorus-containing composition is characterized as a monothiophosphoric acid or monothiophosphate.

The monothiophosphoric acids may be characterized by one or more of the following formulae

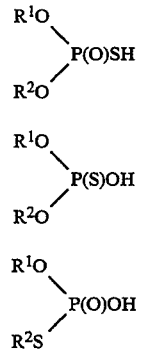

wherein $R^1$ and $R^2$ are defined as above, preferably each $R^1$ and $R^2$ is independently a hydrocarbyl group.

Monothiophosphates may be prepared by the reaction of a sulfur source such as sulfur, hydrocarbyl sulfides and polysulfides and the like and a dihydrocarbyl phosphite. The sulfur source is preferably elemental sulfur.

The preparation of monothiophosphates is disclosed in U.S. Pat. No. 4,755,311 and PCT Publication WO 87/07638 which are incorporated by reference for its disclosure of monothiophosphates, sulfur source for preparing monothiophosphates and the process for making monothiophosphates.

Monothiophosphates may be formed in the lubricant blend by adding a dihydrocarbyl phosphite to a lubricating composition containing a sulfur source. The phosphite may react with the sulfur source under blending conditions (i.e., temperatures from about 30° C. to about 100° C. or higher) to form monothiophosphate. It is also possible that monothiophosphate is formed under the conditions found in operating equipment. In Formula I, when a and b are 1; $X_1$ and $X_2$ are oxygen; and $X_3$ and $X_4$ are sulfur, and $R_3$ is H, the phosphorus-containing composition is characterized as a dithiophosphoric acid or phosphorodithioic acid.

Dithiophosphoric acid may be characterized by the formula

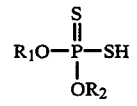

wherein $R_1$ and $R_2$ are as defined above. Preferably $R_1$ and $R_2$ are hydrocarbyl groups.

The dihydrocarbyl phosphorodithioic acids may be prepared by reaction of alcohols with $P_2S_5$ usually between the temperature of about 50° C. to about 150° C. Preparation of dithiophosphoric acids and their salts is well known to those of ordinary skill in the art.

In another embodiment, the phosphorus-containing composition is represented by Formula (I) where each $X_1$ and $X_2$ is oxygen, each $X_3$ and $X_4$ is sulfur, $R_3$ is hydrogen, and each $R_1$ and $R_2$ is independently hydrogen or

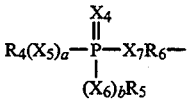

(II)

wherein the various R, a, b and X groups are as defined previously. Preferably either both $R_1$ and $R_2$ are the group of Formula II; or $R_1$ is hydrogen and $R_2$ is the group of Formula II.

Preferably, when each $R_4$ and $R_5$ is independently hydrocarbyl, they are the same as described for $R_1$ or $R_2$. Preferably, $X_5$ and $X_6$ are oxygen, and $X_7$ and $X_8$ are sulfur. Preferably $R_6$ is an arylene group, or an alkylene or alkylidene group having from 1 to about 12, more preferably from about 2 to about 6, more preferably about 3 carbon atoms. $R_6$ is preferably an ethylene, propylene, or butylene, more preferably a propylene group.

The group represented by the Formula II is derived from a compound which is the reaction of a dithiophosphoric acid with an epoxide or a glycol. The dithiophosphoric acids are those described above. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is preferred.

The glycols may be aliphatic glycols having from 1 to about 12, preferably about 2 to about 6, more preferably 2 or 3 carbon atoms, or aromatic glycols. Aliphatic glycols include ethylene glycol, propylene glycol, triethylene glycol and the like. Aromatic glycols include hydroquinone, catechol, resorcinol, and the like.

The reaction product of the dithiophosphoric acid and the glycol or epoxide is then reacted with an inorganic phosphorus reagent such as phosphorus pentoxide, phosphorus trioxide, phosphorus tetraoxide, phosphorus acid, phosphorus halides and the like. The above reaction is known in the art and is described in U.S. Pat. No. 3,197,405 issued to LeSuer. This patent is incorporated herein by reference for its disclosure of dithiophosphoric acids, glycols, epoxides, inorganic phosphorus reagents and methods of reacting the above.

Salts of the foregoing product are also described in LeSuer (U.S. Pat. No. 3,197,405) which is incorporated herein by reference for its disclosures in this regard. Such salts are encompassed within the group of compounds (B-2).

Also included within the compounds identified as (B-1) are compounds of the formula

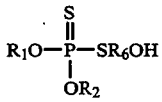

(XI)

wherein each of the groups is the same as identified hereinabove. Preferably $R_1$ and $R_2$ are each alkyl, more preferably containing from 1 to about 30 carbons, even more preferably 1 to about 18 carbons. $R_6$ is alkylene or alkylidene containing from 2 to about 28 carbons, preferably alkylene containing from 2 to about 18 carbons, more preferably 2 to about 6 carbons, even more preferably 2 to 4 carbons. Compounds of Formula (XI) may be prepared by reacting O,O-dihydrocarbyl dithiophosphates with a glycol or epoxide as discussed hereinabove. These compounds and methods for preparing same are described in U.S. Pat. No. 3,197,405 (LeSuer) and U.S. Pat. No. 3,341,633 (Asseff), both of which are hereby expressly incorporated herein by reference for relevant disclosures contained therein.

Triesters can be prepared by reacting the corresponding phosphorus and sulfur containing acid with, for example, an olefin. A detailed discussion of triesters and methods of preparing stone are given in U.S. Pat. No. 2,802,856 (Norman et al) which patent is incorporated herein by reference for relevant disclosures in this regard. Compounds (B-3) include thiophosphites and hydrogen thiophosphites. These are readily prepared by methods known in the art including reaction of mercaptans with phosphorus halides, alcohols with thiophosphorus halides and the like. Preferred are those compounds where a and b are each 1 in Formula III and wherein $R_7$ and $R_8$ are hydrocarbyl, preferably alkyl having from about 1 to about 24 carbons, more preferably from 1 to about 18 carbons, more preferably 4 to about 12 carbons, and aryl having from 6 to about 18 carbons, preferably 6 to about 12 carbons, more preferably 6 to about 10 carbons.

When compound (B-3) has the Formula IV, it is preferred that $R_7$ and $R_8$ are as defined hereinabove, and $R_9$ is hydrocarbyl or hydrogen. In a preferred embodiment $R_9$ is H which is a tautomeric form of Formula III. Alternatively, in another preferred embodiment $R_9$ is hydrocarbyl, preferably alkyl or aryl as defined for $R_7$ and $R_8$ hereinabove.

Preferably said phosphorus and sulfur containing composition is selected from the group consisting of (B-1) a compound represented by the formula

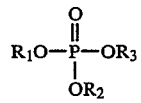

(VI)

wherein each $R_1$, $R_2$ and $R_3$ is independently hydrogen, hydrocarbyl, or

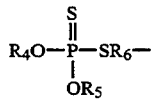

(VII)

provided at least one of $R_1$, $R_2$ and $R_3$ is

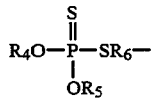

(VII)

wherein each $R_4$ and $R_5$ is independently hydrogen or hydrocarbyl, provided at least one of $R_4$ and $R_5$ is hydrocarbyl, and wherein $R_6$ is an alkylene or alkylidene group;

(B-2) an ammonium or amine salt of (B-1) provided at least $R_3$ is hydrogen;

(B-3) a compound represented by the formula

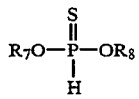

(VIII)

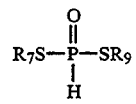

(IX)

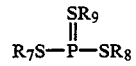

(X)

wherein each $R_7$, $R_8$ and $R_9$ is independently hydrogen or a hydrocarbyl group provided at least one is hydrocarbyl; and (A-4) mixtures of two or more of (A-1 ) to (A-3).

In one especially preferred embodiment the phosphorus and sulfur containing composition is (A-1 ), wherein at least one of $R_1$ and $R_2$ is hydrogen or

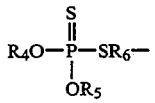

(VII)

provided at least $R_3$ is hydrogen, wherein each $R_4$ and $R_5$ is independently an alkyl group having from about 2 to about 12 carbon atoms and $R_6$ is an alkylene group having from about 2 to about 6 carbon atoms.

In another especially preferred embodiment, the phosphorus and sulfur containing composition is the amine salt (B-2) and is derived from an alkyl amine having from about 1 to about 24 carbon atoms, preferably a tertiary alkyl primary amine containing from about 10 to about 16 carbon atoms.

In a further especially preferred embodiment the phosphorus and sulfur containing composition is the compound (B-3), wherein each $R_7$, $R_8$ and $R_9$ is independently H or an alkyl group containing from 3 to about 24 carbon atoms provided at least one is said alkyl group.

In a particularly preferred embodiment, the phosphorus and sulfur containing composition is one prepared by the process comprising preparing an acidic intermediate by conducting at a temperature of from about 0° C., to about 150° C., a series of reactions comprising reacting approximately equivalent amounts of a phosphorodithioic acid having the formula

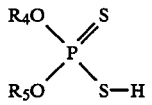

(XII)

wherein each $R_4$ and $R_5$ is independently a hydrocarbyl group with an epoxide and subsequently reacting the product obtained thereby with phosphorus pentoxide, the molar ratio, based on % OH, of the phosphorodithioic acid-epoxide reaction product to phosphorus pentoxide being within the range of from about 2:1 to about 5:1, and neutralizing at a temperature of from about 0° to 200° C., at least about 50% of the acidic mixture with an amine selected from the group consisting of a hydrocarbyl and a hydroxy-substituted hydrocarbyl amine having from about 4 to about 30 carbon atoms. Preferably the amine is a tertiary-alkyl primary amine, more preferably containing from about 10 to about 16 carbon atoms in the tertiary alkyl group.

The following examples illustrate types of sulfur- and phosphorus-containing compounds useful in the grease compositions of this invention. These examples are intended to be illustrative only and are not intended to limit the scope of the invention. Unless indicated otherwise, all parts are parts by weight and temperatures are in degrees Celsius.

EXAMPLE B-1

O,O-di-(2-ethylhexyl) dithiophosphoric acid (354 grams) having an acid number of 154 is introduced into a stainless steel "shaker" type autoclave of 1320 ml. capacity having a thermostatically controlled heating jacket. Propylene is admitted until the pressure rises to 170 pounds per square inch at room temperature, and then the autoclave is sealed and shaken for 4 hours at 50° to 100° C. during which time the pressure rises to a maximum of 550 pounds per square inch. The pressure decreases as the reaction proceeds.

The autoclave is cooled to room temperature, the excess propylene is vented and the contents removed. The product (358 grams), a dark liquid having an acid number of 13.4 is substantially O,O-di-(2-ethylhexyl)-S-isopropyl dithiophosphate.

EXAMPLE B-2

Ammonia is blown into 364 parts (1 equivalent) of the dithiophosphoric acid of Example B-1 until a substantially neutral product is obtained.

EXAMPLE B-3

To 1,780 grams (5 moles) of O,O-di-(2-ethylhexyl) phosphorodithioic acid, stirred at room temperature, there is added portionwise 319 grams (5.5 moles) of propylene oxide. The ensuing reaction is quite exothermic and the temperature rises to 83° C. within 15 minutes. The temperature is maintained at 90°–91° C. for three hours, whereupon an additional 29 grams (0.5 mole) of propylene oxide is added. This mixture is maintained at 90° C. for another hour, followed by stripping to a final temperature of 90° C. at 28 mm Hg pressure. The dark yellow liquid residue shows the following analysis: S, 15.4%; P, 7.4%.

Employing substantially the same procedure of Example 3 the following are reacted:

| Example | Phosphorodithioic acid | Epoxide |
|---|---|---|
| B-4 | O,O'-(4-methyl-2-pentyl) | Epichlorohydrin |
| B-5 | O,O'-(isopropyl) | Propylene oxide |
| B-6 | O,O'-di-(2-ethylhexyl) | Styrene oxide |

EXAMPLE B-7

Phosphorus pentoxide (64 grams, 0.45 mole) is added at 58° C. within a period of 45 minutes to hydroxypropyl O,O-di(4-methyl-2-pentyl) phosphorodithioate (514 grams, 1.35 moles, prepared by treating di(4-methyl-2-pentyl)-phosphoro-dithioic acid with 1.3 moles of propylene oxide at 25° C.). The mixture is heated at 75° C. for 2.5 hours, mixed with a filtering aid (diatomaceous earth), and filtered at 70° C. The filtrate is found to have, by analysis, a phosphorus content of 11.8%, a sulfur content of 15.2%, and an acid number of 87 (bromophenol blue indicator).

EXAMPLE B-8

A mixture of 667 grams (4.7 moles) of phosphorus pentoxide and the hydroxypropyl O,O'-diisopropylphosphorodithioate prepared by the reaction of 3514 grams of diisopropyl phosphorodithioic acid with 986 grams of propylene oxide at 50° C. is heated at 85° C. for 3 hours and filtered. The filtrate has, by analysis, a phosphorus content of 15.3%, a sulfur content of 19.6%, and an acid number of 126 (bromophenol blue indicator).

EXAMPLE B-9

To 217 grams (0.5 equivalent) of the acidic filtrate of Example B-6 there is added at 25° to 60° C. within a period of 20 minutes, 66 grams (0.35 equivalent) of a commercial tertiary aliphatic primary amine (Primene 81-R, Rohm & Haas Co.) having an average molecular weight of 191 in which the aliphatic radical is a mixture of tertiaryalkyl radicals containing from 11 to 14 carbon atoms. The partially neutralized product has by analysis a phosphorus content of 10.2%, a nitrogen content of 1.5%, and an acid number of 26.3.

EXAMPLE B- 10

A portion of the filtrate of Example B-7 (1752 grams) is neutralized by treatment with a stoichiometrically equivalent amount (764 grams) of the aliphatic primary amine of Example 8 at 25°–82° C. The neutralized product has, by analysis, a phosphorus content of 9.95%, a nitrogen content of 2.72%, and a sulfur content of 12.6%.

EXAMPLE B-11

Phosphorus pentoxide (208 grams, 1.41 moles) is added at 50° C. to 60° C. to hydroxypropyl O,O'-diisobutylphosphoro-dithioate (prepared by reacting 280 grams of propylene oxide with 1184 grams of O,O'-diisobutylphosphorodithioic acid at 30° C. to 60° C.). The reaction mixture is heated to 80° C. and held at that temperature for 2 hours. To the acidic reaction mixture there is added a stoichiometrically equivalent mount (384 grams) of the commercial aliphatic primary amine of Example 8 at 30° C. to 60° C. The product is filtered. The filtrate has, by analysis a phosphorus content of 9.31%, a sulfur content of 11.37%, a nitrogen content of 2.50% and a base number of 6.9 (bromphenol blue indicator).

EXAMPLE B-12

To 400 parts of O,O'di-(isoctyl) phosphorodithioic acid is added 308 parts of oleyl amine (Armeen O- Armak).

EXAMPLE B-13

Butyl phosphonic dichloride (175 parts, 1 mole) is reacted with a mixture of 146 parts, 1 mole, 1-octane thiol and 74 parts, 1 mole, 1-butanol.

(C) Hydrocarbyl Phosphites

Compositions of the present invention may also include (C) a hydrocarbyl phosphite. The phosphite may be represented by the following formulae:

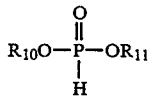

(XIII)

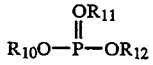

(XIV)

wherein each 'R' group is independently hydrogen or a hydrocarbyl group provided at least one of $R_{10}$ and $R_{11}$ is hydrocarbyl. In an especially preferred embodiment, the phosphite has the formula (XIII) and $R_{10}$ and $R_{11}$ are each, independently, hydrocarbyl.

Within the constraints of the above proviso, it is preferred that each of $R_{10}$, $R_{11}$ and $R_{12}$ is independently a hydrogen or a hydrocarbyl group having from 1 to about 30, more preferably from 1 to about 18, and more preferably from about 1 to about 8 carbon atoms. Each $R_{10}$, $R_{11}$ and $R_{12}$ group may be independently alkyl, alkenyl or aryl. When the group is aryl it contains at least 6 carbon atoms; preferably 6 to about 18 carbon atoms. Examples of alkyl or alkenyl groups are propyl, butyl, hexyl, heptyl, octyl, oleyl, linoleyl, stearyl, etc.

Examples of aryl groups are phenyl, naphthyl, heptylphenyl, etc. Preferably each of these groups is independently propyl, butyl, pentyl, hexyl, heptyl, oleyl or phenyl, more preferably butyl, octyl or phenyl and more preferably butyl.

The groups $R_{10}$, $R_{11}$ and $R_{12}$ may also comprise a mixture of hydrocarbyl groups derived from commercial mixed alcohols.

Examples of monohydric alcohols and alcohol mixtures include commercially available "Alfol" alcohols marketed by Continental Oil Corporation. Alfol 810 is a mixture containing alcohols consisting essentially of straight-chain, primary alcohols having 8 to 10 carbon atoms. Alfol 812 is a mixture comprising mostly $C_{12}$ fatty alcohols. Alfol 1218 is a mixture of synthetic, primary, straight-chain alcohols having from 12 to 18 carbon atoms. Alfol 20+ alcohols are mixtures of 18–28 primary alcohols having mostly, on an alcohol basis, $C_{20}$ alcohols as determined by GLC (gas-liquid-chromatography).

Another group of commercially available alcohol mixtures includes the "Neodol" products available from Shell Chemical Company. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ and $C_{15}$ linear alcohols. Neodol 91 is a mixture of $C_9$, $C_{10}$ and $C_{11}$ alcohols.

Another example of a commercially available alcohol mixture is Adol 60 which comprises about 75% by weight of a straight-chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Phosphites and their preparation are known and many phosphites are available commercially. Particularly useful phosphites are dibutylhydrogen phosphite, trioleyl phosphite and triphenyl phosphite. Preferred phosphite esters are generally dialkyl hydrogen phosphites.

A number of dialkyl hydrogen phosphites are commercially available, such as lower dialkyl hydrogen phosphites, which are preferred. Lower dialkyl hydrogen phosphites include dimethyl, diethyl, dipropyl, dibutyl, dipentyl and dihexyl hydrogen phosphites. Also mixed alkyl hydrogen phosphites are useful in the present invention. Examples of mixed alkyl hydrogen phosphites include ethyl, butyl; propyl, pentyl; and methyl, pentyl hydrogen phosphites.

The preferred dihydrocarbyl phosphites (C) useful in the compositions of the present invention may be prepared by techniques well known in the art, and many are available commercially. In one method of preparation, a lower molecular weight dialkylphosphite (e.g., dimethyl) is reacted with alcohols comprising a straight-chain alcohol, a branched-chain alcohol or mixtures thereof. As noted above, each of the two types of alcohols may themselves comprise mixtures. Thus, the straight-chain alcohol may comprise a mixture of straight-chain alcohols and the branched-chain alcohols may comprise a mixture of branched-chain alcohols. The higher molecular weight alcohols replace the methyl groups (analogous to classic transesterification) with the formation of methanol which is stripped from the reaction mixture.

In another embodiment, the branched chain hydrocarbyl group can be introduced into a dialkylphosphite by reacting the low molecular weight dialkylphosphite such as dimethylphosphite with a more sterically hindered branched-chain alcohol such as neopentyl alcohol (2,2-dimethyl-1-propanol). In this reaction, one of the methyl groups is replaced by a neopentyl group, and, apparently because of the size of the neopentyl group, the second methyl group is not displaced by the neopentyl alcohol. Another neo alcohol having utility in this invention is 2,2,4-trimethyl-1-pentanol.

In another embodiment, mixed aliphatic-aromatic phosphites and aliphatic phosphites may be prepared by reacting an aromatic phosphite such as triphenyl phosphite, with aliphatic alcohols to replace one or more of the aromatic groups with aliphatic groups. Thus, for example, triphenyl phosphite may be reacted with butyl alcohol to prepare butyl phosphites. Dialkyl hydrogen phosphites may be prepared by reacting two moles of aliphatic alcohol with one mole of triphenyl phosphite, subsequently or concurrently with one mole of water.

Dihydrocarbyl phosphites are generally considered to have a tautomeric structure.

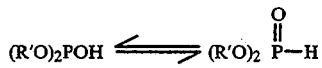

The following examples illustrate the preparation of some of the phosphite esters (C) which are useful in the compositions of the present invention. Unless otherwise indicated in the following examples and elsewhere in the specification and claims, all parts and percentages are by weight, and all temperatures are in degrees Celsius.

EXAMPLE C-1

A mixture of 911.4 parts (7 moles) of 2-ethylhexanol, 1022 parts (7 moles) of Alfol 8–10, and 777.7 parts (7 moles) of dimethylphosphite is prepared and heated to 125° C. while purging with nitrogen and removing methanol as a distillate. After about 6 hours, the mixture was heated to 145° C. and maintained at this temperature for an additional 6 hours whereupon about 406 parts of distillate are recovered. The reaction mixture is stripped to 150° C. at 50 mm. Hg., and an additional 40 parts of distillate are recovered. The residue is filtered through a filter aid and the filtrate is the desired mixed dialkyl hydrogen phosphite containing, by analysis, 9.6% phosphorus (theory, 9.7%).

EXAMPLE C-2

A mixture of 468.7 parts (3.6 moles) of2-ethylhexanol, 1050.8 parts (7.20 moles) of Alfol 8–10, and 600 parts (5.4 moles) of dimethylphosphite is prepared and heated to 135° C. while purging with nitrogen. The mixture is heated slowly to 145° C. and maintained at this temperature for about 6 hours whereupon a total of 183.4 parts of distillate are recovered. The residue is vacuum stripped to 145° C. (10 mm. Hg.) and 146.3 parts of additional distillate are recovered. The residue is filtered through a filter aid, and the filtrate is the desired product containing 9.3% phosphorus (theory, 9.45%).

EXAMPLE C-3

A mixture of 518 parts (7 moles) of n-butanol, 911.4 parts (7 moles) of 2-ethylhexanol, and 777.7 parts (7 moles) of dimethylphosphite is prepared and heated to 120° C. while blowing with nitrogen. After about 7 hours, 322.4 parts of distillate are collected, and the material then is vacuum stripped (50 mm. Hg. at 140° C.) whereupon an additional 198.1 parts of distillate are recovered. The residue is filtered through a filter aid, and the filtrate is the desired product containing 12.9% phosphorus (theory, 12.3%).

EXAMPLE C-4

A mixture of 193 parts (2.2 moles) of 2,2-dimethyl-l-propanol and 242 parts (2.2 moles) of dimethylphosphite is prepared and heated to about 120° C. while blowing with nitrogen. A distillate is removed and collected, and the residue is vacuum stripped. The residue is filtered and the filtrate is the desired product containing 14.2% phosphorus.

As used herein, the term "hydrocarbyl" or "hydrocarbyl group" denotes a group having a carbon atom directly attached to the remainder of the molecule and having predominantly hydrocarbon character within the context of this invention. Thus, the term "hydrocarbyl" includes hydrocarbon, as well as substantially hydrocarbon groups. Substantially hydrocarbon describes groups, including hydrocarbon based groups, which contain non-hydrocarbon substituents, or non-carbon atoms in a ring or chain, which do not alter the predominantly hydrocarbon nature of the group.

Hydrocarbyl groups can contain up to three, preferably up to two, more preferably up to one, non-hydrocarbon substituent, or non-carbon heteroatom in a ring or chain, for every ten carbon atoms provided this non-hydrocarbon substituent or non-carbon heteroatom does not significantly alter the predominantly hydrocarbon character of the group. Those skilled in the art will be aware of such heteroatoms, such as oxygen, sulfur and nitrogen, or substituents, which include, for example, hydroxyl, halo (especially chloro and fluoro), alkyoxyl, alkyl mercapto, alkyl sulfoxy, etc.

Examples of hydrocarbyl groups include, but are not necessarily limited to, the following:

(1) hydrocarbon groups, that is, aliphatic (e.g., alkyl or alkenyl), alicyclic (e.g., cycloalkyl, cycloalkenyl) groups, aromatic groups (e.g., phenyl, naphthyl), aromatic-, aliphatic- and alicyclic-substituted aromatic groups and the like as well as cyclic groups wherein the ring is competed through another portion of the molecule (that is, for example, any two indicated groups may together form an alicyclic radical);

(2) substituted hydrocarbon groups, that is, those groups containing non-hydrocarbon containing substituents which, in the context of this invention, do not significantly alter the predominantly hydrocarbon character; those skilled in the art will be aware of such groups (e.g., halo (especially chloro and fluoro), hydroxy, alkoxy, mercapto, alkylmercapto, nitro, nitroso, sulfoxy, etc.);

(3) hetero groups, that is, groups which will, while having a predominantly hydrocarbon character within the context of this invention, contain atoms other than carbon present in a ring or chain otherwise composed of carbon atoms. Suitable heteroatoms will be apparent to those of ordinary skill in the art and include, for example, sulfur, oxygen, nitrogen. Such groups as, e.g., pyridyl, furyl, thienyl, imidazolyl, etc. are representative of heteroatom containing cyclic groups.

Typically, no more than about 2, preferably no more than one, non-hydrocarbon substituent or non-carbon atom in a chain or ring will be present for every ten carbon atoms in the hydrocarbyl group. Usually, however, the hydrocarbyl groups are purely hydrocarbon and contain substantially no such non-hydrocarbon groups, substituents or heteroatoms.

Unless indicated otherwise, hydrocarbyl groups are substantially saturated. By substantially saturated it is meant that the group contains no more than one carbon-to-carbon unsaturated bond, olefinic unsaturation, for every ten carbon-to-carbon bonds present. Often, they contain no more than one carbon-to-carbon non-aromatic unsaturated bond for every 50 carbon-to-carbon bonds present. Frequently, hydrocarbyl groups are substantially free of carbon to carbon unsaturation. It is to be understood that, within the content of this invention, aromatic unsaturation is not normally considered to be olefinic unsaturation. That is, aromatic groups are not considered as having carbon-to-carbon unsaturated bonds.

As mentioned hereinabove, component (B) may be used individually or together with components (A) and (C) in minor amounts effective to increase the dropping point of the base complex or failed complex grease.

Preferred minimum amounts of sulfur and phosphorus containing compound to employ individually depends to some extent upon the additive. When the sulfur and phosphorus containing additive is (B- 1) it is preferred to use at least about 0.75% by weight. The same is true when the additive is (B-2) but the preferred minimum amount of (B-3) is about 0.25% by weight.

It generally is not necessary to use more than about 10% by weight of the sulfur and phosphorus containing compound since no additional benefit is obtained and often, deteriorating performance with respect to the dropping point and other characteristics of the grease is observed above this treating level. More often no more than about 5% frequently no more than about 2% of the sulfur and phosphorus containing compound is employed. Often 1% by weight is sufficient to provide an increase in dropping point.

When components (A), (B) and (C) are used together, preferred minimum amounts of each component to use in the grease compositions also depend to some extent upon the specific nature of the component, but generally at least about 0.25% of each component should be present. Useful amounts of component (A) range from about 0.25% to about 10% by weight, preferably about 0.5% to about 5%, more preferably from about 1% to about 2%. With respect to component (B), useful mounts for the purposes of this invention range from about 0.25% to about 5% by weight, preferably from about 0.5% to about 3%, more preferably from about 0.5% to about 1% by weight. Component (C) is generally present in amounts ranging from about 0.25% to about 5%, preferably from about 0.5% to about 3%, more preferably from about 0.75% to about 2% by weight, more often up to about 1% by weight.

Components (A), (B) and (C) are used in relative amounts by weight ranging from about 1 part (A) to 20 parts each (B) and (C) to about 40 parts (A) to 1 part each (B) and (C). Preferably, the components are used in amounts ranging from about 1 part (A) to 10 parts each (B) and (C) to about 10 parts (A) to about 1 part each (B) and (C), more preferably from about 1 part (A) to 5 parts each (B) and (C) to about 5 parts (A) to 1 part each (B) and (C).

It generally is not necessary to use more than a total of about 20% by weight of components (A), (B) and (C) since no additional benefit is obtained and often, deteriorating performance with respect to the dropping point and other characteristics of the grease is observed above this treating level. More often no more than a total of about 10%, frequently no more than about 5% is employed. Often 1%–3% by weight is sufficient to provide an increase in dropping point.

Thus, it is preferred to use the minimum mount of the additives consistent with attaining the desired dropping point elevation.

Components (A), (B) and (C) may be present during grease formation, i.e., during formation of the thickener, or may be added after the base grease has been prepared. In many cases it is preferred to add the components to the preformed base grease since they may be adversely affected during preparation of metal soap and complex thickeners.

Other additives may be incorporated into the base grease to improve performance of the grease as a lubricant. Such other additives including corrosion inhibitors, antioxidants, extreme pressure additives and others useful for improving specific performance characteristics of a base grease, are well-known and will readily occur to those skilled in the art. Oftentimes these other additives have an adverse effect on the dropping point of the grease. Use of component (B), or (A), (B) and (C) together with these other additives often compensates for this effect.

The following examples illustrate grease compositions of this invention or comparative examples which indicate the benefits obtained employing this invention. It is to be understood that these examples are intended to be illustrations and are not intended to be limiting in any way. Dropping points are determined using ASTM Procedure D-2265. All amounts unless indicated otherwise are on an oil free basis and are by weight. Temperatures, unless indicated otherwise, are in degrees Celsius.

EXAMPLE A

A lithium 12-hydroxystearate thickened base grease showed dropping point of 210° C. This is a typical simple lithium salt thickened base grease.

EXAMPLE B

To a Hobart mixer are added 352 parts 12-hydroxy stearic acid (Cenwax A, Union Camp), 2000 parts mineral oil (800 SUS @40° C.) and 2 parts of silicone antifoam. The materials are heated to 82° C. at which time is added an 82° C. solution of 90.8 parts $LiOH.H_2O$ (FMC) in 400 parts water. Water is removed for 1.5 hours, temperature is increased to 143° C. and 118 parts azelaic acid (Aldrich) are added. The temperature is held at 143° C. for 0.5 hours then increased to 200° C. and maintained at 200° C. for 0.5 hours. The materials are cooled by adding 1437 parts 800 SUS mineral oil. The resultant materials are milled at 0.003 inch clearance between rotator and stator and 3000 revolutions per minute. The dropping point is 195° C. indicating complex grease formation did not take place.

EXAMPLE C

To a Hobart mixer are added 5600 parts mineral oil (800 SUS @40° C.), 680 parts of 12-hydroxy stearic acid (Cenwax A, Union Camp) and 320 parts azelaic acid. The materials are heated to 100° C. followed by slow addition of a solution at 82° C. of 224 parts $LiOH.H_2O$ in 800 parts tap water. The reaction mixture is heated at 104° C. for 1.5 hours to dehydrate. The temperature is increased to 190° C. and held there for 1 hour. Heating is discontinued and 1176 parts additional 800 SUS mineral oil is added. The grease is a complex grease with a dropping point of 285° C.

EXAMPLE D–F

Grease compositions are prepared by blending into the base grease of Example B the indicated percentages by weight of the product obtained by reacting 1000 parts of O,O'-(di)-methylamyl dithiophosphoric acid prepared by reacting about 4 moles methyl amyl alcohol with 1 mole of $P_2S_5$ with 183 parts of propylene oxide, reacting the product obtained thereby with 144 parts of $P_2O_5$ and neutralizing the acid product obtained thereby with 584 parts of Primene 81-R.

| Example | % by weight additive | Dropping Point (°C.) |
|---|---|---|
| D | 0.6 | 263 |
| E | 1.0 | 261 |
| F | 2.0 | 290 |

EXAMPLE G

A grease composition is prepared by blending into the complex grease of Example C 2% by weight of the sulfur and phosphorus containing product described in Examples D–F. The dropping point increases from 285° C. to 336° C.

For comparative purposes, a grease composition is prepared employing a conventional phosphorus containing additive which is substantially free of sulfur.

EXAMPLE H

A grease composition is prepared by blending into the failed complex base grease of Example B 0.9% by weight of dibutyl hydrogen phosphite ((Butyl-0)$_2$PHO). The dropping point is 201° C. This value is within the expected repeatability of the test procedure indicating that the additive has no significant effect on dropping point of the failed complex grease.

EXAMPLE I–P

An additive concentrate is prepared by blending at a moderately elevated temperature dibutyl hydrogen phosphite, the calcium overbased salicylate of Example A-14 and the phosphorus and sulfur containing composition of Example B-10 in a weight ratio of 0.9:1.7:0.6. No adjustment is made for the oil content of the calcium overbased salicylate.

Grease compositions are prepared by blending into the base grease of example B the indicated percentages by weight of the above-described additive concentrate.

| Example | % By Weight Concentrate | Dropping Point (°C.) |
|---|---|---|
| I | 3.2 | 267 |
| J | 1.6 | 280 |
| K | 6.4 | 214 |
| L | 4.8 | 223 |
| M | 2.4 | 283 |
| N | 2.8 | 244 |
| O | 3.0 | 255 |
| P | 3.5 | 253 |

EXAMPLE Q

Three percent by weight of the additive concentrate of Examples I–P is added to a complex grease prepared in a manner similar to that of Example C. The dropping point increases from 285° C. to 334° C.

EXAMPLES R–U

To each of the grease compositions of Examples D, G, I and Q is added 0.5% by weight of a sulfurized isobutylene.

EXAMPLES V–Y

Examples D, G, I and Q are repeated replacing the lithium base grease with a calcium soap-calcium acetate complex base grease.

From the foregoing Examples it is apparent that certain sulfur and phosphorus containing compositions used individually or in combination with overbased compositions and a hydrocarbyl phosphite provide increased dropping points compared to the base greases without additive.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An improved grease composition comprising a major amount of an oil-based, metal soap thickened base grease selected from the group consisting of complex grease and failed complex grease and (B) from about 0.25% to about 5% by weight of a phosphorus and sulfur containing composition selected from the group consisting of (B-1) a compound represented by the formula

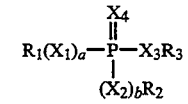

(I)

wherein each $X_1$, $X_2$, $X_3$ and $X_4$ is independently oxygen or sulfur provided at least one is sulfur; each a and b is independently 0 or 1; and wherein each $R_1$, $R_2$ and $R_3$ is independently hydrogen, hydrocarbyl, a group of the formula

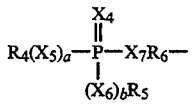

(II)

wherein each $R_4$ and $R_5$ is independently hydrogen or hydrocarbyl, provided at least one of $R_4$ and $R_5$ is hydrocarbyl, $R_6$ is an alkylene or alkylidene group, each a and b is independently 0 or 1, and each $X_5$, $X_6$, $X_7$ and $X_8$ is independently oxygen or sulfur;

or a group of the formula $—R_6OH$, wherein $R_6$ is an alkylene or alkylidene group;

(B-2) an amine or an ammonium salt of (B-1) when at least $R_3$ is hydrogen;

(B-3) a compound represented by the formula

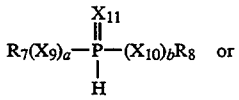

(III)

or

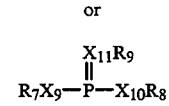

(IV)

wherein each $R_7$, $R_8$ and $R_9$ is independently hydrogen or a hydrocarbyl group provided at least one is hydrocarbyl and each $X_9$, $X_{10}$ and $X_{11}$ is oxygen or sulfur provided at least one is sulfur; and (B-4) mixtures of two or more of (B-1) to (B-3) thereof; wherein the dropping point of the base grease is increased by at least about 15° C. as measured by ASTM procedure D-2265.

2. The grease composition of claim 1, wherein the metal of the metal soap is an alkali metal, an alkaline earth metal or aluminum.

3. The grease composition of claim 2, wherein the metal of the metal soap is an alkali metal.

4. The grease composition of claim 2, wherein the metal of the metal soap is an alkaline earth metal.

5. The grease composition of claim 3, wherein the alkali metal is sodium or lithium.

6. The grease composition of claim 4, wherein the alkaline earth metal is calcium or magnesium.

7. The grease composition of claim 1 wherein the metal soap is formed from a metal soap of a fatty acid and a complexing agent selected from the group consisting of aromatic carboxylic acids, lower carboxylic acids and α-w dicarboxylic acids.

8. The grease composition of claim 1 wherein the base grease is a complex grease.

9. The grease composition of claim 1 wherein the base grease is a failed complex grease.

10. The grease composition of claim 1 further comprising (A) from about 0.25% to about 10% by weight of an overbased salt of an organic acid and (C) from about 0.25 to about 5% by weight of a hydrocarbyl phosphite.

11. The grease composition of claim 7, wherein the fatty acid is a $C_8$ to $C_{24}$ mono-carboxylic acid.

12. The grease composition of claim 11, wherein the mono-carboxylic acid is hydroxy-substituted.

13. The grease composition of claim 10 wherein the overbased metal salt (A) is an alkali, an alkaline earth metal salt or a zinc salt.

14. The grease composition of claim 10 wherein the overbased metal salt (A) is selected from the group consisting of carboxylates, phenates and sulfonates.

15. The grease composition of claim 1, wherein the phosphorus and sulfur containing composition is (B-1) and a and b are each 1.

16. The grease composition of claim 15, wherein one of $X_1$, $X_2$ and $X_3$ is sulfur and the rest are oxygen.

17. The grease composition of claim 15, wherein each $R_1$, $R_2$ and $R_3$ is independently hydrogen or

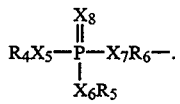

(V)

18. The grease composition of claim 16, wherein $R_3$ is hydrogen and each $R_1$ and $R_2$ is independently hydrogen or

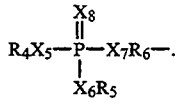

(V)

19. The grease composition of claim 1, wherein the phosphorus and sulfur containing composition is the ammonium or amine salt (B-2) and a and b are each 1.

20. The grease composition of claim 1, wherein the phosphorus and sulfur containing composition is the compound (B-3).

21. The grease composition of claim 10, wherein each hydrocarbyl group of the phosphite (C) independently contains from 1 to about 30 carbon atoms.

22. An improved grease composition comprising a major amount of a metal soap thickened hydrocarbon-based mineral oil or synthetic oil base grease selected from the group consisting of complex grease and failed complex grease, and (B) from about 0.25% to about 5% by weight of at least one sulfur and phosphorus containing composition selected from the group consisting of (B-1) a compound represented by the formula

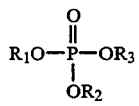

(VI)

wherein each $R_1$, $R_2$ and $R_3$ is independently hydrogen, hydrocarbyl, or

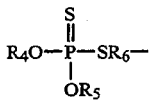

(VII)

provided at least one of $R_1$, $R_2$ and $R_3$ is

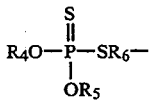

(VII)

wherein each $R_4$ and $R_5$ is independently hydrogen or hydrocarbyl, provided at least one of $R_4$ and $R_5$ is hydrocarbyl, and wherein $R_6$ is an alkylene or alkylidene group;

(B-2) an ammonium or an amine salt of (B-1) provided at least $R_3$ is hydrogen;

(B-3) a compound represented by at least one of the following formulae:

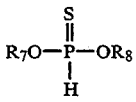

(VIII)

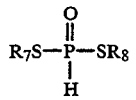

(XI)

or

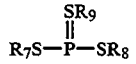

(X)

wherein each of $R_7$, $R_8$ and $R_9$ is independently hydrogen or a hydrocarbyl group provided at least one is hydrocarbyl;

(B-4) mixtures of two or more of (B-1)-(B-3); and wherein the dropping point of the base grease is increased by at least about 15° C. as measured by ASTM procedure D-2265.

23. The grease composition of claim 22 wherein the base grease is a complex grease.

24. The grease composition of claim 22 wherein the base grease is a failed complex grease.

25. The grease composition of claim 22 further comprising (A) from about 0.25% to about 10% by weight of an organic acid and (C) from about 0.25 to about 5% by weight of a hydrocarbyl phosphite.

26. The grease composition of claim 25 wherein the organic acid is selected from the group consisting of carboxylic acids, sulfonic acids and phenols.

27. The grease composition of claim 25 wherein the metal salt is (A-1) a carboxylate containing at least about 8 carbon atoms.

28. The grease composition of claim 25 wherein the metal salt is (A-2) an alkylbenzene sulfonate containing one or two alkyl substituents.

29. The grease composition of claim 28 wherein (A-2) contains at least one alkyl substituent containing at least about 12 carbon atoms.

30. The grease composition of claim 25 wherein the metal salt is (A-3) an alkyl or alkenyl substituted phenate.

31. The grease composition of claim 25 wherein the overbased metal salt (A) contains at least one alkyl or alkenyl substituent containing at least about 8 carbon atoms.

32. The grease composition of claim 25 wherein the overbased alkaline earth metal salt (A) is selected from the group consisting of calcium, magnesium or barium salts.

33. The grease composition of claim 22, wherein the metal of the metal soap is an alkali metal, an alkaline earth metal or aluminum.

34. The grease composition of claim 33, wherein the metal is an alkali metal selected from the group consisting of sodium or lithium or an alkaline earth metal selected from the group consisting of calcium or magnesium.

35. The grease composition of claim 22, wherein the fatty acid component of the metal soap is a 12-hydroxy stearate.

36. The grease composition of claim 33 wherein the grease is an aluminum grease wherein the acids making up the metal soap thickener comprise a fatty acid and an aromatic acid.

37. The grease composition of claim 34 wherein the grease is a lithium grease wherein the acids making up the metal soap thickener comprise a hydroxy-fatty acid and an $\alpha$-w dicarboxylic acid containing from about 3 to about 12 carbon atoms.

38. The grease composition of claim 34 wherein the grease is a calcium grease wherein the acids making up the metal soap thickener comprise a fatty acid and a lower carboxylic acid.

39. The grease composition of claim 22, wherein the phosphorus and sulfur containing composition is (B-1), wherein at least one of $R_1$ and $R_2$ is hydrogen or

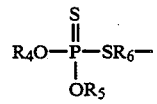

(VII)

provided at least $R_3$ is hydrogen, wherein each $R_4$ and $R_5$ is independently an alkyl group having from about 2 to about 12 carbon atoms and $R_6$ is an alkylene group having from about 2 to about 6 carbon atoms.

40. The grease composition of claim 22, wherein the phosphorus and sulfur containing composition is the amine salt (B-2) and is derived from an alkyl amine having from about 1 to about 24 carbon atoms.

41. The grease composition of claim 40, wherein the amine is a tertiary alkyl primary amine containing from about 10 to about 16 carbon atoms.

42. The grease composition of claim 22, wherein the phosphorus and sulfur containing composition is the compound (B-3), wherein each R is independently a propyl, butyl, pentyl or oleyl group.

43. The grease composition of claim 1, wherein the phosphorus and sulfur containing composition is (B-1) having the formula

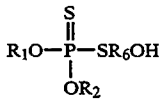

(XI)

wherein each of $R_1$ and $R_2$ is alkyl containing from 1 to about 18 carbon atoms and $R_6$ is alkylene containing from 2 to about 18 carbon atoms.

44. A grease composition comprising a major amount of an oil-based, metal soap thickened base grease selected from the group consisting of complex grease and failed complex grease and minor amounts of (A) a metal overbased aliphatic hydrocarbon substituted aromatic carboxylate;

(B) at least one phosphorus and sulfur containing composition prepared by the process comprising preparing an acidic intermediate by conducting at a temperature of from about 0° C., to about 150° C., a series of reactions comprising reacting approximately equivalent amounts of a phosphorodithioic acid having the formula

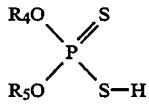

(XII)

wherein each $R_4$ and $R_5$ is independently a hydrocarbyl group and an epoxide and subsequently reacting the product obtained thereby with phosphorus pentoxide, the molar ratio of the phosphorodithioic acid-epoxide reaction product to phosphorus pentoxide being within the range of from about 2:1 to about 5:1, then neutralizing at a temperature of from about 0° to 200° C., at least about 50% of the acidic mixture with an amine selected from the group consisting of a hydrocarbyl and a hydroxy-substituted hydrocarbyl amine having from about 4 to about 30 carbon atoms; and (C) at least one dihydrocarbyl phosphite of the formula

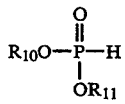

(XIII)

wherein each of $R_{10}$ and $R_{11}$ is independently a hydrocarbyl group containing from 1 to about 50 carbon atoms and wherein (A) is present in amounts ranging from about 0.25% to about 10% by weight, and (B) and (C) are each independently present in amounts ranging from about 0.25% to about 5% by weight, to increase the dropping point of the base grease by at least about 15° C. as measured by ASTM procedure D-2265.

45. The grease composition of claim 44 wherein the base grease is a complex grease.

46. The grease composition of claim 44 wherein the base grease is a failed complex grease.

47. The grease composition of claim 44 wherein the overbased metal carboxylate (A) is an alkyl or alkenyl substituted salicylate wherein the substituent contains from about 12 to about 50 carbon atoms.

48. The grease composition of claim 44 wherein the epoxide contains from 2 to about 18 carbon atoms wherein each of $R_{10}$ and $R_{11}$ is an alkyl group containing from 1 to about 18 carbon atoms.

49. The grease composition of claim 44 wherein (A) is an overbased calcium alkyl salicylate having a metal ratio of from 3 to about 20, (B) is prepared by reacting the phosphorodithioic acid wherein $R_3$ and $R_4$ each independently is an aliphatic group having from 3 to about 12 carbon atoms or an aromatic group containing from 6 to about 12 carbon atoms, with an epoxide having from 2 to about 4 carbon atoms then reacting the product obtained thereby with about 1 mole, per 2.5 to about 3.5 moles of phosphorodithioic acid-epoxide reaction product of phosphorus pentoxide then neutralizing at least about 50% of the acidic mixture with an alkyl amine containing from about 8 to about 16 carbon atoms; and wherein (C) is a dialkyl phosphite wherein each of $R_{10}$ and $R_{11}$, independently, contains from about 1 to about 6 carbon atoms.

50. The grease composition of claim 49, wherein the amine is a tertiary-alkyl primary amine.

51. The grease composition of claim 50 comprising from about 0.5% to about 5% by weight of (A), from about 0.25–3% by weight of (B) and from 0.25–3% by weight of (C).

52. A method of increasing the dropping point of an oil-based metal soap thickened base grease selected from the group consisting of complex grease and failed complex grease by at least about 15° C. as measured by ASTM procedure D-2265 comprising incorporating therein (B) from about 0.25% to about 5% by weight of a phosphorus and sulfur containing composition selected from the group consisting of (B-1) a compound represented by the formula

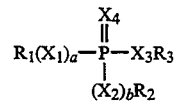

(I)

wherein each $X_1$, $X_2$, $X_3$ and $X_4$ is independently oxygen or sulfur provided at least one is sulfur; each a and b is independently 0 or 1; and wherein each $R_1$, $R_2$ and $R_3$ is independently hydrogen, hydrocarbyl, a group of the formula

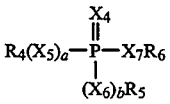

(II)

wherein each $R_4$ and $R_5$ is independently hydrogen or hydrocarbyl, provided at least one of $R_4$ and $R_5$ is hydrocarbyl, $R_6$ is an alkylene or alkylidene group, each a and b is independently 0 or 1, and each $X_5$, $X_6$, $X_7$ and $X_8$ is independently oxygen or sulfur; or a group of the formula —$R_6$OH, wherein $R_6$ is an alkylene or alkylidene group;

(B-2) an amine or an ammonium salt of (B-1) when at least $R_3$ is hydrogen;

(B-3) a compound represented by the formula

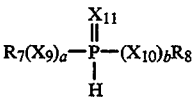

(III)

-continued

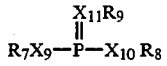

(IV)

wherein each $R_7$, $R_8$ and $R_9$ is independently hydrogen or a hydrocarbyl group provided at least one is hydrocarbyl and each $X_9$, $X_{10}$ and $X_{11}$ is oxygen or sulfur provided at least one is sulfur; and (B-4) mixtures of two or more of (B-1) to (B-3) thereof.

53. The method of claim 52 wherein the method comprises also adding (A) from about 0.25% to about 10% by weight of an overbased metal salt of a hydrocarbyl substituted organic acid and (C) from about 0.25% to about 5% by weight of a hydrocarbyl phosphite.

* * * * *